US007762444B2

(12) United States Patent
Berrocal et al.

(10) Patent No.: US 7,762,444 B2
(45) Date of Patent: Jul. 27, 2010

(54) TOOL FOR SECURING TOGETHER TWO OR MORE LAYERS OF A MATTRESS USING A PLASTIC FASTENER

(75) Inventors: William G. Berrocal, Holly Springs, NC (US); John Godfrey, Lincolnton, NC (US)

(73) Assignee: Avery Dennison Corporation, Pasadena, CA (US)

( * ) Notice: Subject to any disclaimer, the term of this patent is extended or adjusted under 35 U.S.C. 154(b) by 316 days.

(21) Appl. No.: 11/665,779

(22) PCT Filed: Dec. 1, 2005

(86) PCT No.: PCT/US2005/043313

§ 371 (c)(1),
(2), (4) Date: Nov. 26, 2007

(87) PCT Pub. No.: WO2006/060474

PCT Pub. Date: Jun. 8, 2006

(65) Prior Publication Data

US 2008/0289113 A1 Nov. 27, 2008

Related U.S. Application Data

(60) Provisional application No. 60/632,287, filed on Dec. 1, 2004.

(51) Int. Cl.
*B65C 7/00* (2006.01)

(52) U.S. Cl. ..... 227/67; 29/235; 29/252

(58) Field of Classification Search ..... 227/67, 227/71, 119, 152, 142; 29/235, 252
See application file for complete search history.

(56) References Cited

U.S. PATENT DOCUMENTS 1,986,839 A 1/1935 Marquardt
2,059,478 A 11/1936 Noel (Continued)

FOREIGN PATENT DOCUMENTS

EP 1 253 107 A1 10/2002

(Continued)

*Primary Examiner*—Scott A. Smith
(74) *Attorney, Agent, or Firm*—Kriegsman & Kriegsman

(57) ABSTRACT

A method for coupling together at least two layers (23, 25, 27, 29, 21-1) of a mattress includes the steps of aligning each layer in its proper position in relation to the other layers of the mattress (11) and, after the alignment step, inserting a plastic fastener (31) through the layers. A fastener dispensing tool (211) is provided for inserting plastic fasteners (31)through the layers (23, 25, 27, 29, 21-1) of the mattress(11). In one embodiment, the fastener dispensing tool (211) includes a housing (213), a hollow sharpened needle (229) fixedly coupled to the housing (213), an ejection mechanism for advancing a cross-bar of the plastic fastener through the hollow needle, a needle guard slidably coupled to the housing over a portion of the sharpened needle, and a needle guard stop slidably coupled to the housing in such a manner so that it can be releasably fixed place in either of two or more set positions.

20 Claims, 38 Drawing Sheets

U.S. PATENT DOCUMENTS

| | | | | | |
|---|---|---|---|---|---|
| 2,281,104 | A | | 4/1942 | Marquardt | |
| 3,598,025 | A | * | 8/1971 | Cotton | 493/38 |
| 3,880,339 | A | * | 4/1975 | Bone | 227/8 |
| 4,237,779 | A | * | 12/1980 | Kunreuther | 493/376 |
| 4,315,587 | A | * | 2/1982 | Ritter et al. | 227/67 |
| 4,323,183 | A | * | 4/1982 | Duchin | 227/3 |
| 4,627,563 | A | * | 12/1986 | Meyer | 227/130 |
| 4,681,248 | A | | 7/1987 | Duchin | |
| 4,718,590 | A | * | 1/1988 | Engelhardt | 227/67 |
| 4,988,335 | A | * | 1/1991 | Prindle et al. | 604/61 |
| 5,471,727 | A | | 12/1995 | Kubota | |
| 5,598,948 | A | | 2/1997 | Rizer | |
| 5,950,901 | A | * | 9/1999 | Kubota | 227/71 |
| 6,267,285 | B1 | * | 7/2001 | Raymond et al. | 227/67 |
| 6,874,215 | B2 | | 4/2005 | Flippin | |
| 7,017,205 | B2 | | 3/2006 | Gladney | |
| 7,103,933 | B2 | | 9/2006 | Gladney et al. | |
| 2007/0017034 | A1 | | 1/2007 | Creekmuir | |

FOREIGN PATENT DOCUMENTS

| | | | |
|---|---|---|---|
| EP | 1 738 672 | A1 | 1/2007 |
| WO | WO 02/32767 | A1 | 4/2002 |
| WO | WO 2004/006719 | A2 | 1/2004 |
| WO | WO 2004/034841 | A2 | 4/2004 |
| WO | WO 2005/046397 | A2 | 5/2005 |
| WO | WO 2006/001890 | A2 | 1/2006 |
| WO | WO 2006/044309 | A2 | 4/2006 |

* cited by examiner

TOOL FOR SECURING TOGETHER TWO OR MORE LAYERS OF A MATTRESS USING A PLASTIC FASTENER

CROSS-REFERENCE TO RELATED APPLICATIONS

The present application claims the benefit under 35 U.S.C. 119(e) of U.S. Provisional Patent Application Ser. No. 60/632,287, filed Dec. 1, 2004, the disclosure of which is incorporated herein by reference.

BACKGROUND OF THE INVENTION

The present invention relates generally to the manufacture of mattresses.

Mattresses are well-known in the art and are commonly used alone or in combination with additional components to form a bed on which a person may rest and/or sleep. Many types of conventional mattresses comprise a spring unit to provide its user with a satisfactory level of support and comfort.

A mattress spring unit typically includes an upper frame and a lower frame which are spaced slightly apart and which are arranged in a substantially parallel configuration. Each frame (also commonly referred to as a wire box) includes a rigid and durable wire, or rod, which is formed into a substantially rectangular design, said wire defining the outer periphery of its associated frame. In addition, a mattress spring unit typically comprises a plurality of uniformly spaced apart metal springs, or coils, which extend between the upper and lower frames. Each spring includes a longitudinal axis which extends substantially at a right angle relative to the upper and lower frames. As can be appreciated, the plurality of springs enables the upper frame to move, or give, towards the lower frame when a downward force is applied onto the upper frame. As a result, when an individual rests on the upper frame of the spring unit, the body weight of said individual is uniformly absorbed by the plurality of springs, which is highly desirable.

A layer of cushioning material, in the form of a pad, is typically secured onto each frame of a mattress spring unit. The layer of cushioning material is commonly in the form of a non-woven fabric having an approximate thickness of ¾ of an inch. One type of cushioning material which is commonly secured onto the upper and lower frames of a mattress spring unit is a Flexatron® cushioning pad which is manufactured by Kingsdown, Inc.

The layer of cushioning material is typically secured onto each frame of the mattress spring unit in the following manner. Specifically, the layer of cushioning material is disposed against the outer surface of each frame. The outer periphery of each layer of material is pulled tightly past the wire of its associated frame. A short length of said layer is then wrapped around the wire and is disposed against the underside of a portion of said layer, thereby creating a double thickness portion of said layer of material with said wire trapped therebetween. With said layer of cushioning material double-backed in the manner described above, a conventional, pneumatically-driven staple gun is used to secure together the double-backed portion of said layer of material, thereby trapping the wire therewithin.

Typically, metallic C-shaped staples, or rings, are used to secure together the double-backed portion of said layer of material at approximately 2 inch intervals. Specifically, the staple gun dispenses each C-shaped staple through the double-backed portion of said layer of material and bends the sharpened free ends of each C-shaped staple into direct alignment and contact with one another.

With a layer of cushioning material secured onto each wire box of a mattress spring unit, many high-end mattresses often dispose 2, 3 or 4 layers of varying density foam rubber on top of the spring unit. As can be appreciated, these layers of foam rubber serve to significantly increase the level of comfort of the mattress, which is highly desirable. Having disposed multiple layers of foam rubber onto the mattress spring unit, an outer layer of fabric (e.g., a quilted cotton material) is sewn over the spring unit and the layers of foam to form the finished mattress.

It should be noted that conventional high-end mattress manufacturing techniques secure together particular layers of the mattress (and, in particular, the multiple layers of foam rubber) using an adhesive prior to sewing the outer layer of quilted cotton material around the remainder of the mattress. Specifically, one or both of the contact surfaces of adjacent layers are sprayed with an adhesive. With the adhesive sprayed onto one or both of the contact surfaces of adjacent layers, the layers are first aligned and then drawn into contact with one another.

It should be noted that the aforementioned method of using adhesives to secure together multiple layers of a mattress suffers from a few notable drawbacks.

As a first drawback, the use of adhesives to secure together multiple layers of a mattress results in a significant level of waste. Specifically, if the layers of material are secured together in misalignment, there is no means to separate the layers and attempt to re-secure the layers. As a result, layers of material which are secured together in misalignment are often discarded as waste, thereby increasing manufacturing costs, which is highly undesirable.

As a second drawback, the use of adhesives to secure together multiple layers of a mattress creates an unhealthy amount of fumes where the mattress is manufactured, thereby creating a potentially hazardous working environment, which is highly undesirable.

As a third drawback, the use of adhesives to secure together multiple layers of a mattress often creates audible crackling sounds as the adhesives age, which is highly undesirable.

SUMMARY OF THE INVENTION

It is an object of the present invention to provide a new and improved tool for dispensing plastic fasteners.

It is another object of the present invention to provide a new and improved tool for dispensing plastic fasteners through two or more layers of a mattress.

It is yet another object of the present invention to provide a tool as described above which is designed to dispense plastic fasteners of the type which include a cross-bar formed onto each end of an elongated filament.

Therefore, according to one feature of the present invention, there is provided a tool for dispensing a plastic fastener, the plastic fastener comprising a cross-bar formed onto one end of a thin filament, said tool comprising (a) a housing, (b) a hollow needle fixedly coupled to the housing, the hollow needle comprising a sharpened tip, (c) an ejection mechanism for advancing the cross-bar of the plastic fastener through the hollow needle, (d) a needle guard slidably coupled to the housing, the needle guard being adapted for slidable displacement between an extended position in which sharpened tip of the hollow needle is substantially protected by the needle guard and a retracted position in which the sharpened tip of the needle is exposed, and (e) a needle guard stop slidably coupled to the needle guard, the needle guard stop being adapted to be releasably fixed in place in either of two or more set positions, (f) wherein, when in its retracted position, the needle guard contacts the needle guard stop so as to limit further retraction of the needle guard and thereby regulate the portion of the hollow needle that is exposed.

According to another feature of the present invention, there is provided a tool for dispensing a plastic fastener, the plastic fastener comprising a cross-bar formed onto one end of a thin filament, said tool comprising (a) a housing, (b) a hollow needle fixedly coupled to the housing, the hollow needle comprising a sharpened tip, (c) an ejection mechanism for advancing the cross-bar of the plastic fastener through the hollow needle, (d) a needle guard slidably coupled to the housing, the position of the needle guard relative to the hollow needle defining the portion of the hollow needle that is exposed for insertion, and (e) a locking member for locking the needle guard fixed in place in either of two or more set positions.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 4(*b*) is a front, top perspective view of the tool shown in FIG. 4(*a*);

FIG. 4(*c*) is a partially exploded, rear, top perspective view of the tool shown in FIG. 4(*a*);

FIG. 4(*d*) is a top plan view of the tool shown in FIG. 4(*a*);

FIG. 4(*e*) is a rear plan view of the tool shown in FIG. 4(*a*);

FIG. 11(*b*) is an enlarged, fragmentary, rear, top perspective view of the tool shown in FIG. 4(*a*);

FIG. 36(*b*) is an enlarged, fragmentary, front perspective view of the leading end of the right side casing shown in FIG. 16(*a*);

FIG. 41(*b*) is a rear, top perspective view of the tool shown in FIG. 41(*a*), the tool being shown with its needle guard disposed in its retracted position;

FIG. 42(*b*) is an enlarged, fragmentary view of the tool shown in FIG. 41(*b*);

DETAILED DESCRIPTION OF THE PREFERRED EMBODIMENT

Figure 1:
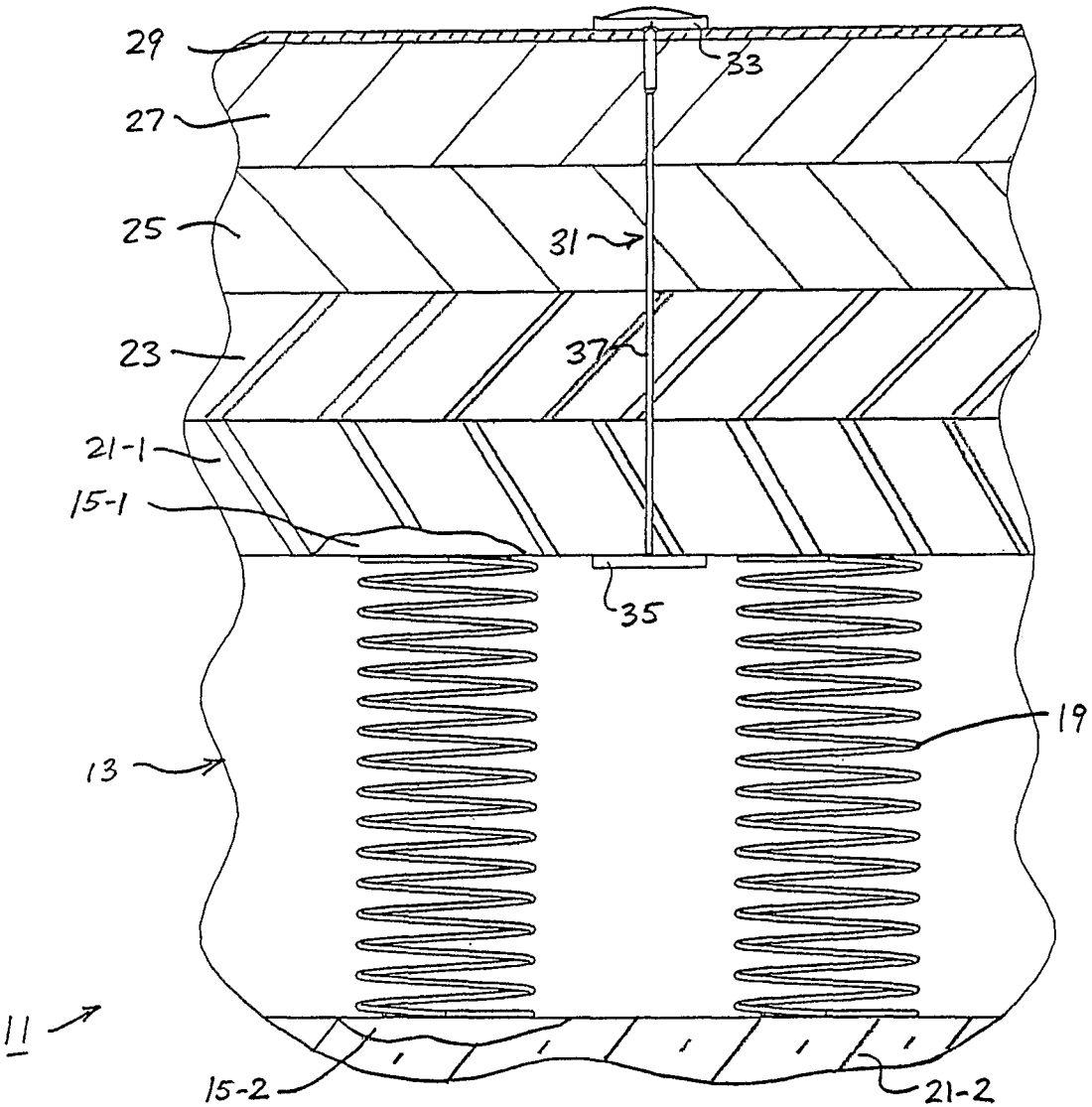
FIG. 1 is a fragmentary section view, broken away in part, of a first embodiment of a mattress constructed according to the teachings of the present invention, the fastener not being shown in section for purposes of clarity.

Referring now to FIG. 1, there is shown a fragmentary, front plan, section view, broken away in part, of a mattress constructed according to the teachings of the present invention, said mattress being identified generally by reference numeral 11.

Mattress 11 comprises a conventional mattress spring unit 13. Mattress spring unit 13 includes identical upper and lower frames 15-1 and 15-2 which are spaced slightly apart and which are arranged in a substantially parallel configuration. Each frame 15 (also referred to herein as a wire box) includes a rigid and durable wire, or rod, (not shown) which is formed into a substantially rectangular design, the wire defining the outer periphery of its associated frame 15.

Mattress spring unit 13 additionally includes a plurality of uniformly spaced apart metal springs, or coils, 19 which extend between upper and lower frames 15-1 and 15-2. Each spring 19 includes a longitudinal axis which extends substantially at a right angle relative to the upper and lower frames 15-1 and 15-2. As can be appreciated, springs 19 enable upper frame 15-1 to move, or give, towards lower frame 15-2 when a downward force is applied onto upper frame 15-1. As a result, when an individual rests on upper frame 15-1, the body weight of said individual is uniformly absorbed by the plurality of springs 19, which is highly desirable.

A layer of cushioning material 21-1 is preferably secured onto frame 15-1 of mattress spring unit 13. Similarly, a layer of cushioning material 21-2 is preferably secured onto frame 15-2 of mattress spring unit 13. Each layer of cushioning material 21 is preferably in the form of a non-woven fabric pad (e.g., a Flexatron® cushioning pad) having an approximate thickness of ¾ of an inch.

Layer of cushioning material 21 is secured onto each frame 15 in the following manner. Specifically, layer of cushioning material 21 is disposed against the outer surface of each frame 15. The outer periphery of each layer of cushioning material 21 is pulled tightly past the wire of its associated frame 15. The free end of each layer of cushioning material 21 is then wrapped around its associated wire and is double-backed against the underside of the remainder of layer of cushioning material 21, thereby creating a double thickness portion of layer 21 with the wire trapped therebetween. With layer of cushioning material 21 double-backed in the manner described above, a metallic C-shaped staple or other fastening device (not shown) is disposed through the double-backed portion of layer 21 so as to retain layer of cushioning material 21 onto its associated frame 15.

With layers of material 21 secured onto frames 15 of spring unit 13, multiple layers of varying density foam rubber are mounted onto layer of cushioning material 21-1 in proper alignment therewith. Specifically, a first layer of foam rubber 23 is mounted onto layer 21-1 in proper alignment therewith, a second layer of foam rubber 25 is mounted onto first layer of foam rubber 23 in proper alignment therewith, and a third layer of foam rubber 27 is mounted onto second layer of foam rubber 25 in proper alignment therewith. Furthermore, an outer layer of fabric 29, such as a quilted cotton material, is mounted onto third layer of foam rubber 27 in proper alignment therewith.

With layers of foam rubber 23, 25 and 27 and outer layer of fabric 29 mounted onto spring unit 13 in the manner described above, one or more plastic fasteners 31 are used to retain the various layers of mattress 11 in position, as will be described further in detail below. It should be noted that the use of plastic fasteners 31 in the manufacturing of mattress 11 serves as a principal novel feature of the present invention.

Plastic fastener 31 is preferably in the form of a conventional heavy duty plastic fastener. In particular, plastic fastener 31 is preferably in the form of an H-shaped heavy duty fastener of the type sold by Avery Dennison Corporation as part of the Extra Heavy Duty T-End™ system. Specifically, plastic fastener 31 is preferably in the form of a 3 inch plastic member which includes a first end shaped to define a cross-bar 33 (also commonly referred to as a "T-bar"), a second end similarly shaped to define a cross-bar 35 (also commonly referred to as a "T-bar"), and a thin filament 37 interconnecting cross-bars 33 and 35.

Figure 23:
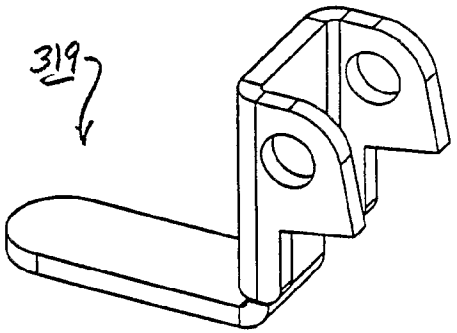
FIG. 23 is an enlarged, front, top, right end perspective view of the trigger shown in FIG. 19.

Plastic fastener 31 is preferably mass-produced in a unitary form known commonly as fastener stock. The fastener stock is constructed in a clip-type assembly in which individual plastic fasteners 31 are arranged in a spaced, side-by-side orientation, with the respective cross-bars 33 and 35 parallel to one another, each of cross-bars 35 being joined to a common, orthogonally-disposed runner bar 39 by a severable connector 41, as seen most clearly in FIG. 23. The aforementioned fastener clip is typically manufactured through the process of injection molding.

Preferably, plastic fasteners 31 are used to secure together cushioning layer 21-1, foam layers 23, 25 and 27, and outer layer 29 at approximately 2 inch intervals. As seen most clearly in FIG. 1, with a fastener 31 dispensed through the aforementioned layers, cross-bar 33 lies flat against the top surface of outer layer 29 and cross-bar 35 lies flat against the bottom surface of cushioning layer 21-1.

Figure 2:
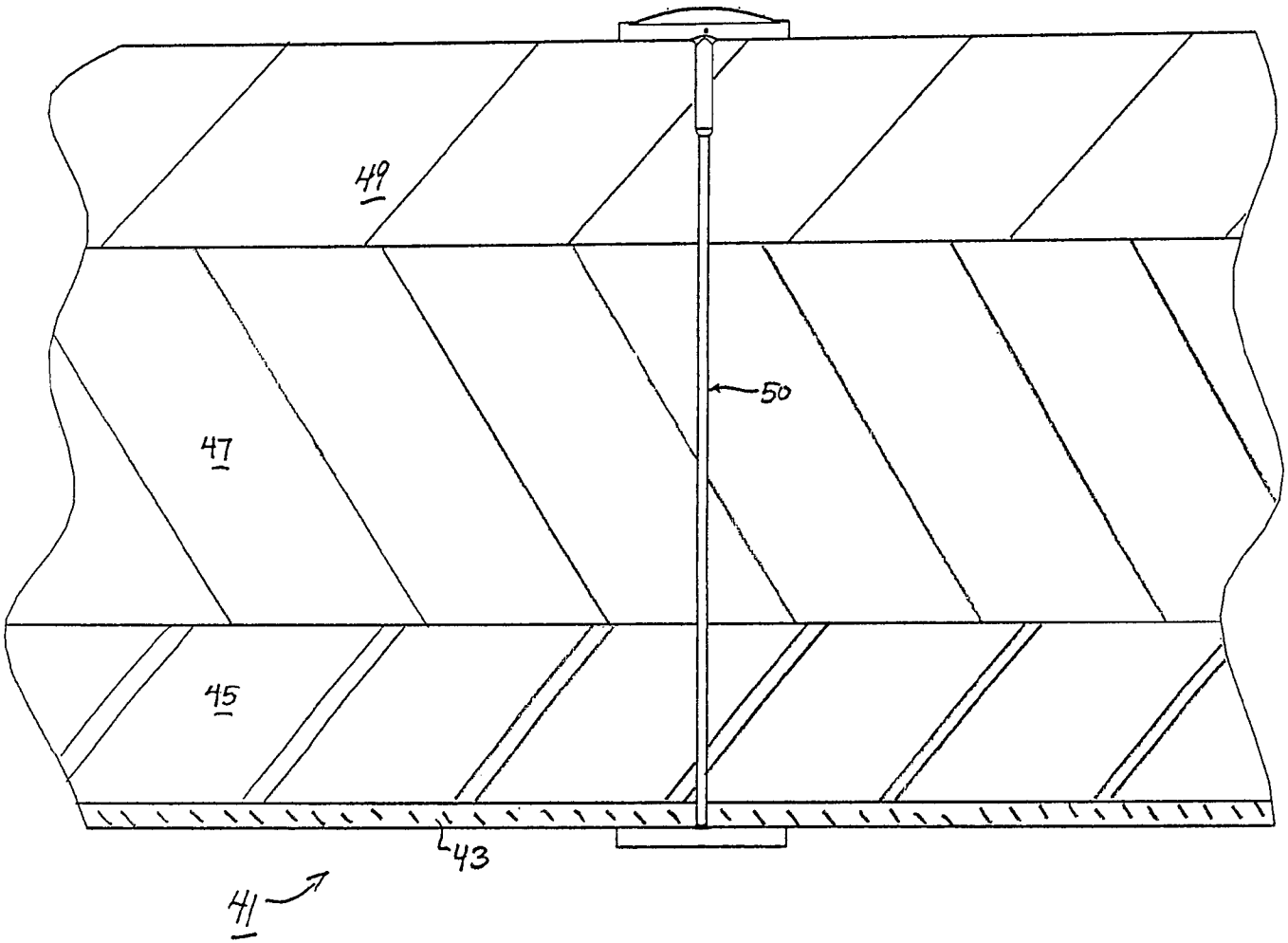
FIG. 2 is a fragmentary section view of a pillow top which may be inserted into the mattress shown in FIG. 1, the fastener not being shown in section for purposes of clarity.

It should be noted that additional layers may be inserted into mattress 11 without departing from the spirit of the present invention. Specifically, FIG. 2 shows a pillow top 41 which may be inserted into mattress 11 for additional support and comfort. Pillow top 41 comprises a thin fabric layer 43 (e.g., a thin, non-woven sheet of polyethylene) which may be of the type commonly referred to in the art as Versare fabric. Pillow top 41 additionally comprises first, second and third layers of foam 45, 47 and 49 which are stacked in proper alignment on fabric layer 43.

Preferably, pillow top 41 is inserted into mattress 11 between foam layer 27 and outer layer 29. A fastener 50, similar in construction to fastener 31 but potentially having a different overall length, may be used to couple together layers 43, 45, 47, and 49, as seen most clearly in FIG. 2, prior to the insertion of pillow top 41 into mattress 11. Also, a fastener similar in construction to fastener 31 but potentially having a greater overall length may be driven through all of layers 21, 23, 25, 27, 43, 45, 47, 49 and 29.

Figure 3:
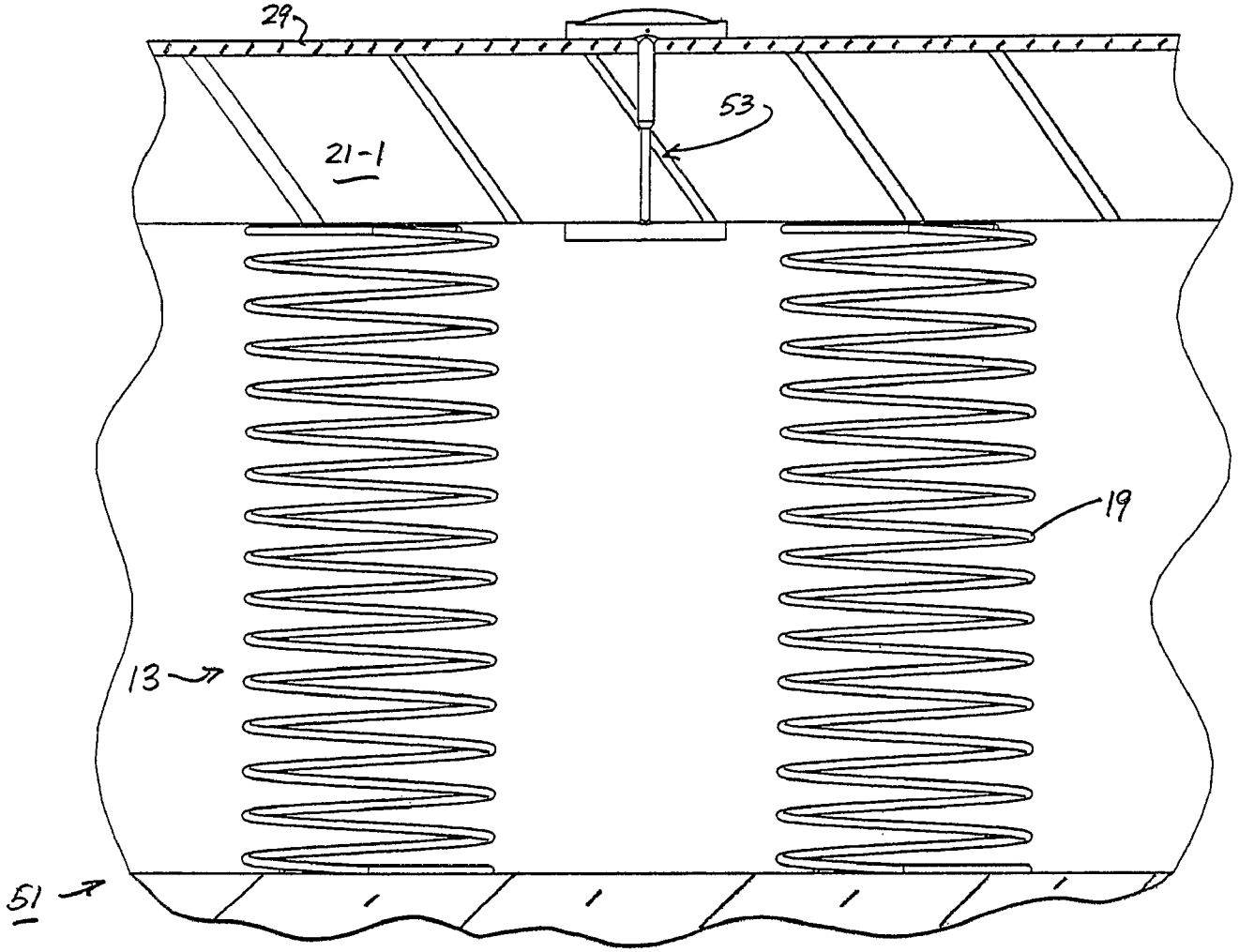
FIG. 3 is a fragmentary section view of a second embodiment of a mattress constructed according to the teachings of the present invention, the fastener not being shown in section for purposes of clarity.

It should also be noted that layers may be removed from mattress 11 without departing from the spirit of the present invention. Specifically, FIG. 3 shows a mattress 51 which differs in construction from mattress 11 in that mattress 51 does not include foam layers 23, 25 and 27. Because mattress 51 is substantially thinner than mattress 11, mattress 51 preferably includes a fastener 53 which has a shorter overall length than fastener 31.

Figure 4:
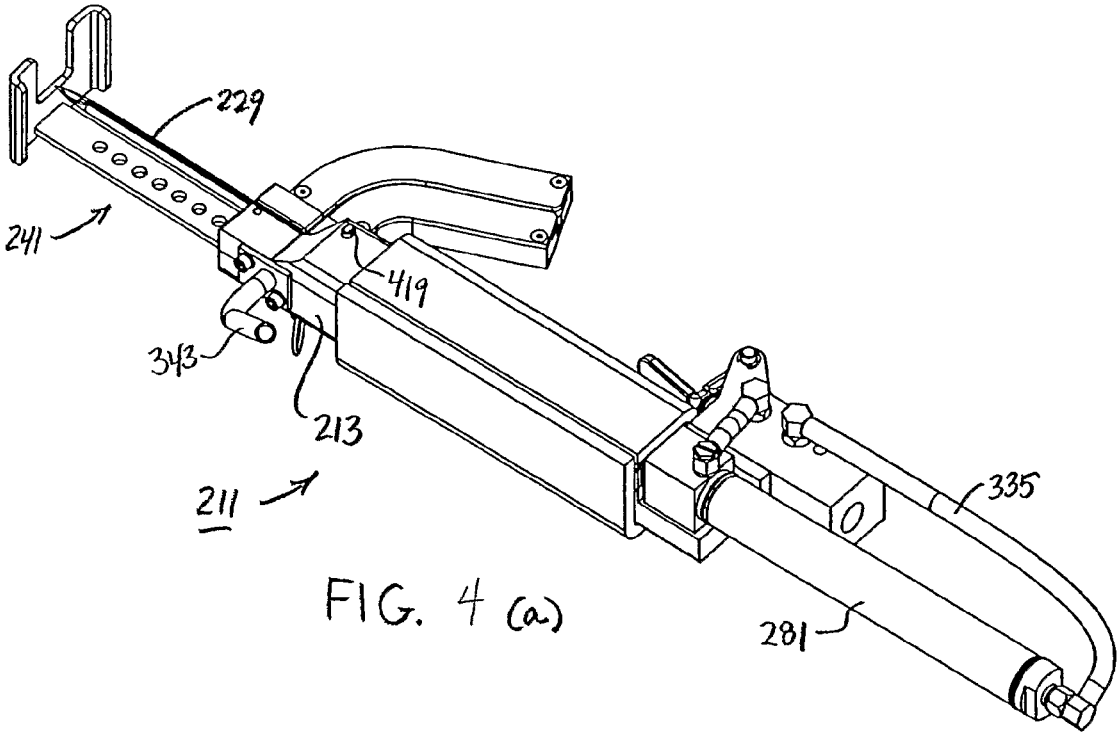
FIG. 4(*a*) is a front, bottom perspective view of a first embodiment of a tool for dispensing a plastic fastener through one or more layers of a mattress, said tool being constructed according to the teachings of the present invention.
Figure 4:
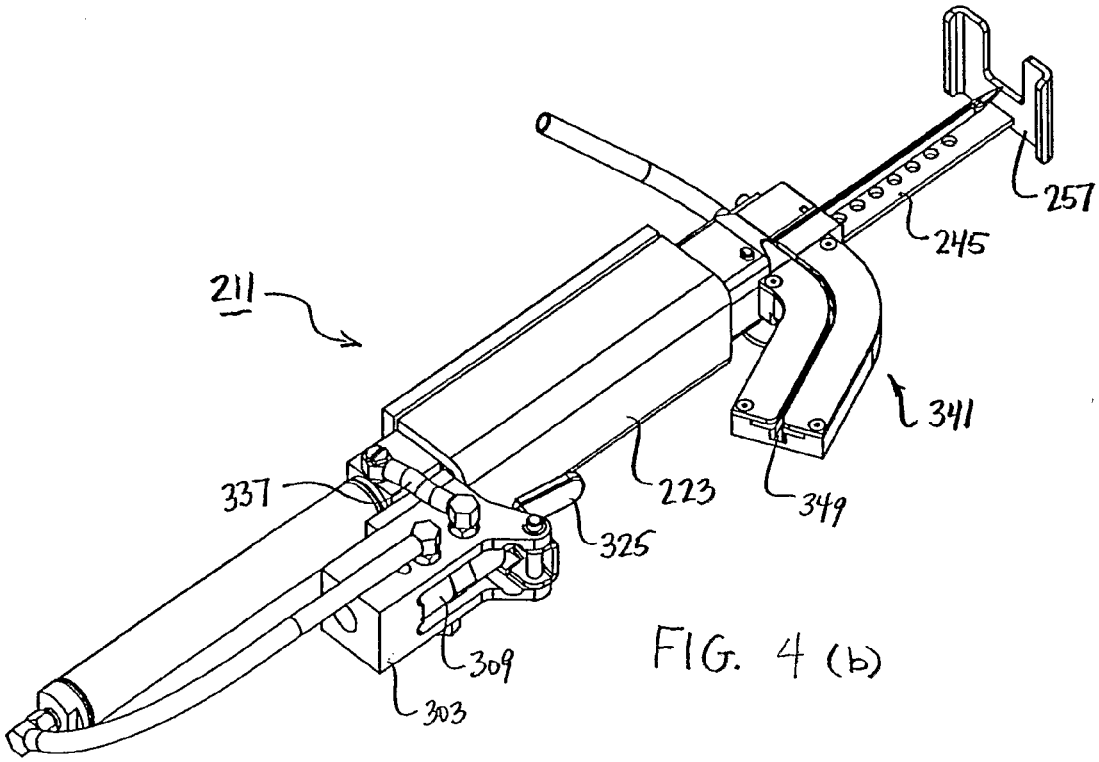
Figure 4:
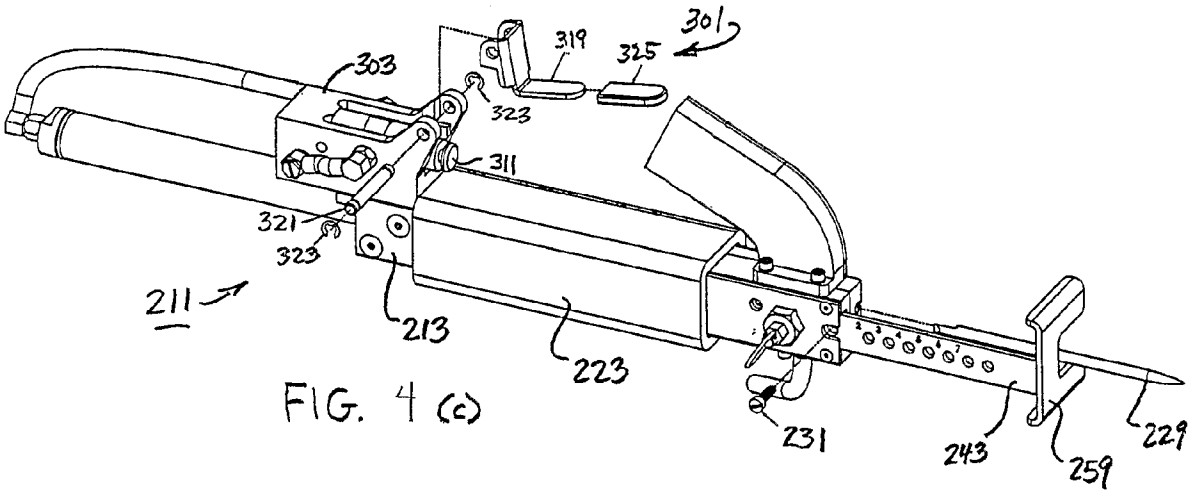
Figure 4:
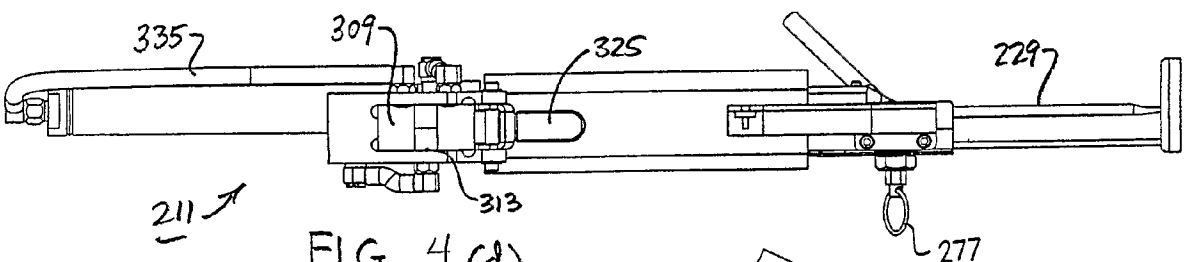
Figure 4:
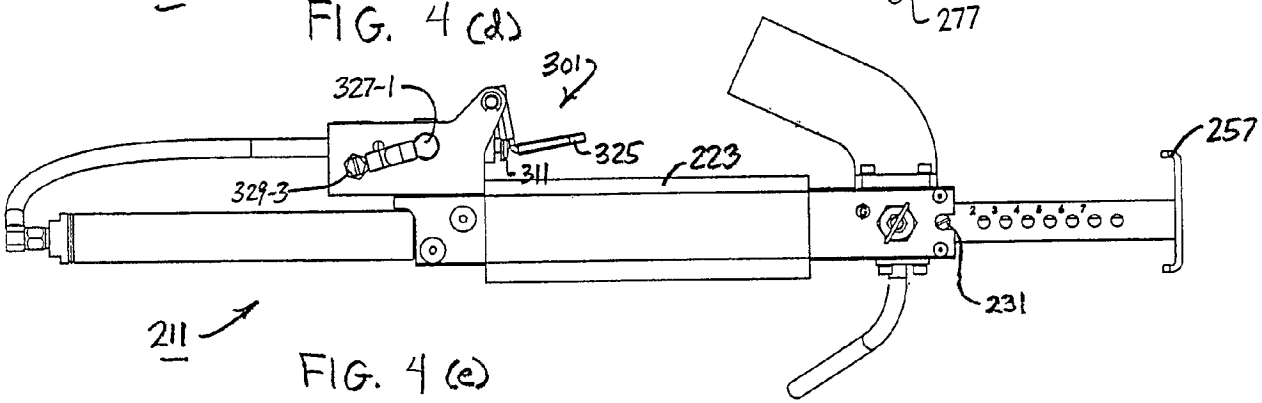

Referring now to FIGS. 4(*a*)-(*e*), there are shown various views of a first embodiment of a tool for use in dispensing one or more plastic fasteners, said tool being constructed according to the teachings of the present invention and identified generally by reference numeral 211. As will be described further below, tool 211 is designed principally for use in installing heavy-duty plastic fasteners, such as fastener 31, through multiple layers of a mattress, such as mattress 11.

Tool 211 is an air compression powered fastener dispensing tool. Preferably, tool 211 is derived from an $SPU_4M$ model, extra heavy duty T-end fastener dispensing tool of the type manufactured and sold by Avery Dennison Corporation of Pasadena, Calif. which has been modified in a number of ways, as will be described in detail herein.

Figure 6:
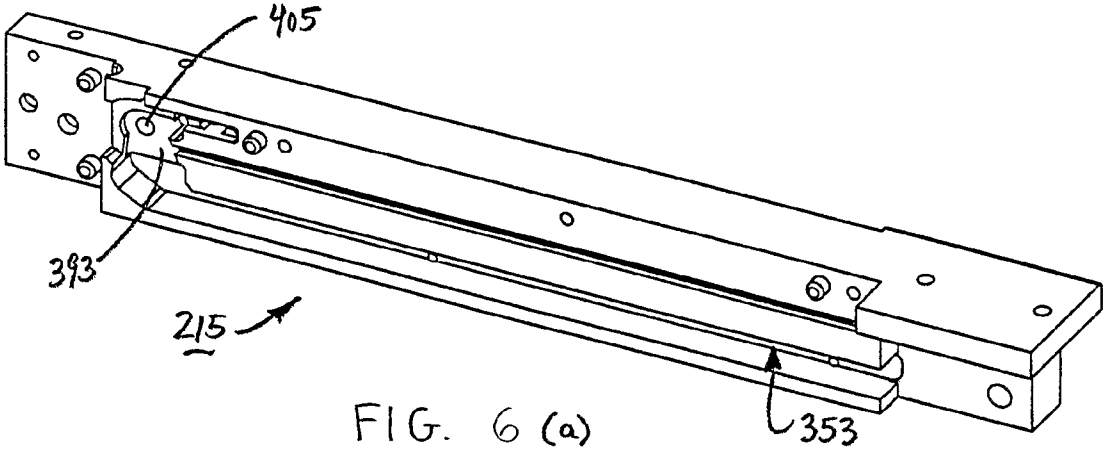
FIGS. 6(*a*)-(*b*) are front, top perspective and rear, top perspective views, respectively, of the right side casing of the tool shown in FIG. 4(*a*)
Figure 6:
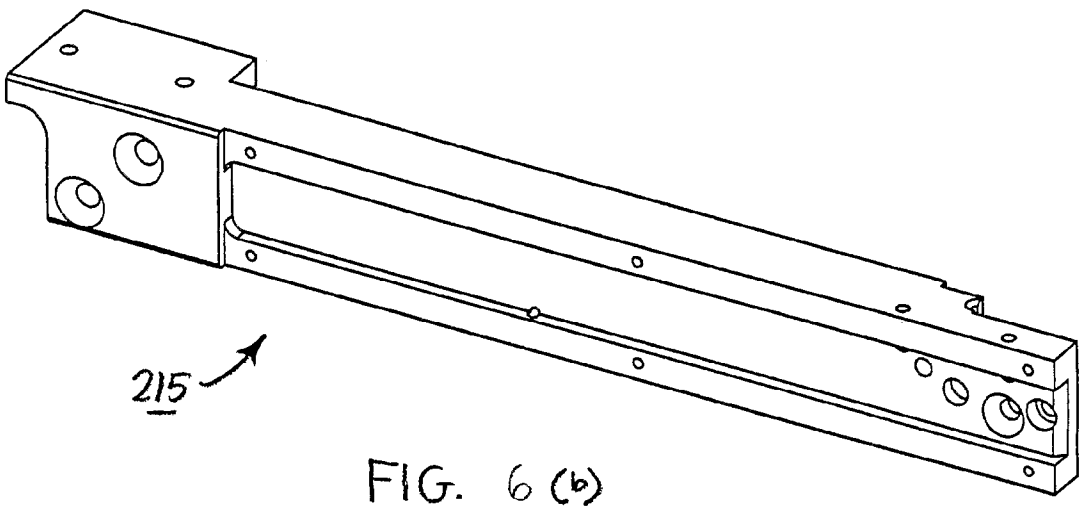
Figure 7A:
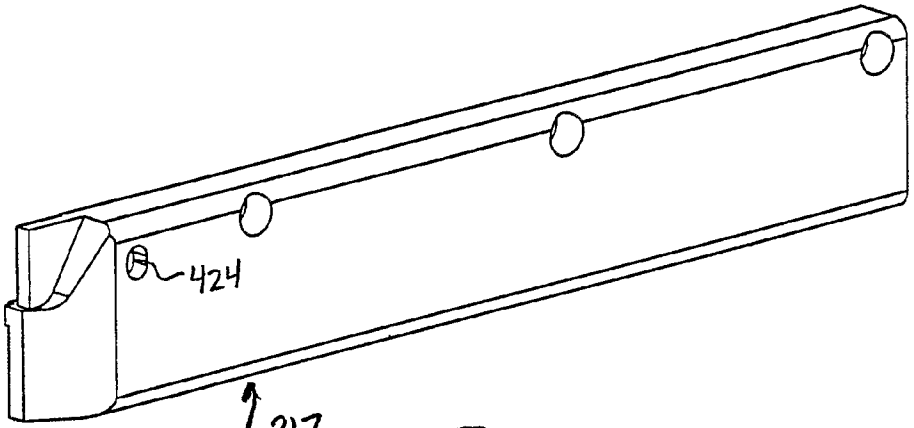
FIGS. 7(*a*)-(*b*) are front, top perspective and rear, top perspective views, respectively, of the left side casing of the tool shown in FIG. 4(*a*)
Figure 7B:
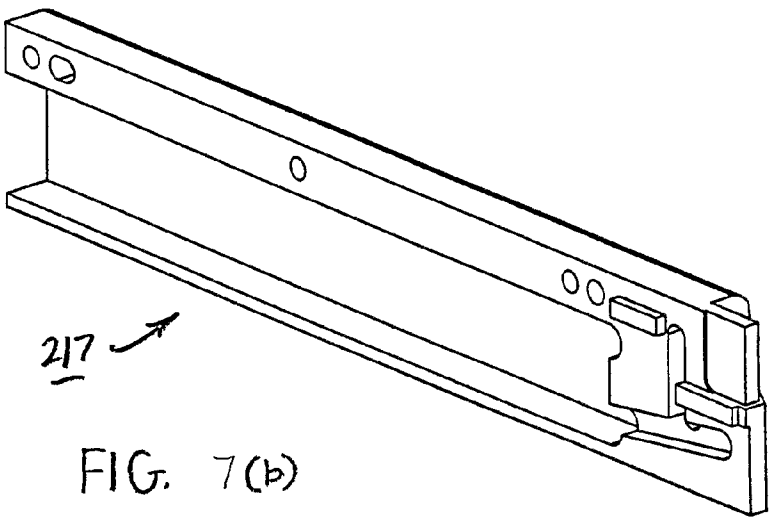

Tool 211 comprises a protective housing 213 which is constructed of a rigid and durable material. As seen most clearly in FIG. 5, housing 213 comprises a right side casing 215 (shown in isolation in FIGS. 6(*a*) and 6(*b*)) and a left side casing 217 (shown in isolation in FIGS. 7(*a*) and 7(*b*)) which are secured together using the combination of a lock washer 219 and a cap screw 221 at one or more locations. As seen most clearly in FIGS. 4(*a*)-(*e*), a four-sided handle 223 (shown in isolation in FIG. 8) constructed of a soft material, such as foam rubber, is wrapped around a portion of right and left side casings 215 and 217 and is held in place by any conventional means (e.g., through the use of hook and pile type fasteners). In this manner, handle 223 facilitates the gripping of hand-operated tool 211, which is highly desirable.

Figure 5:
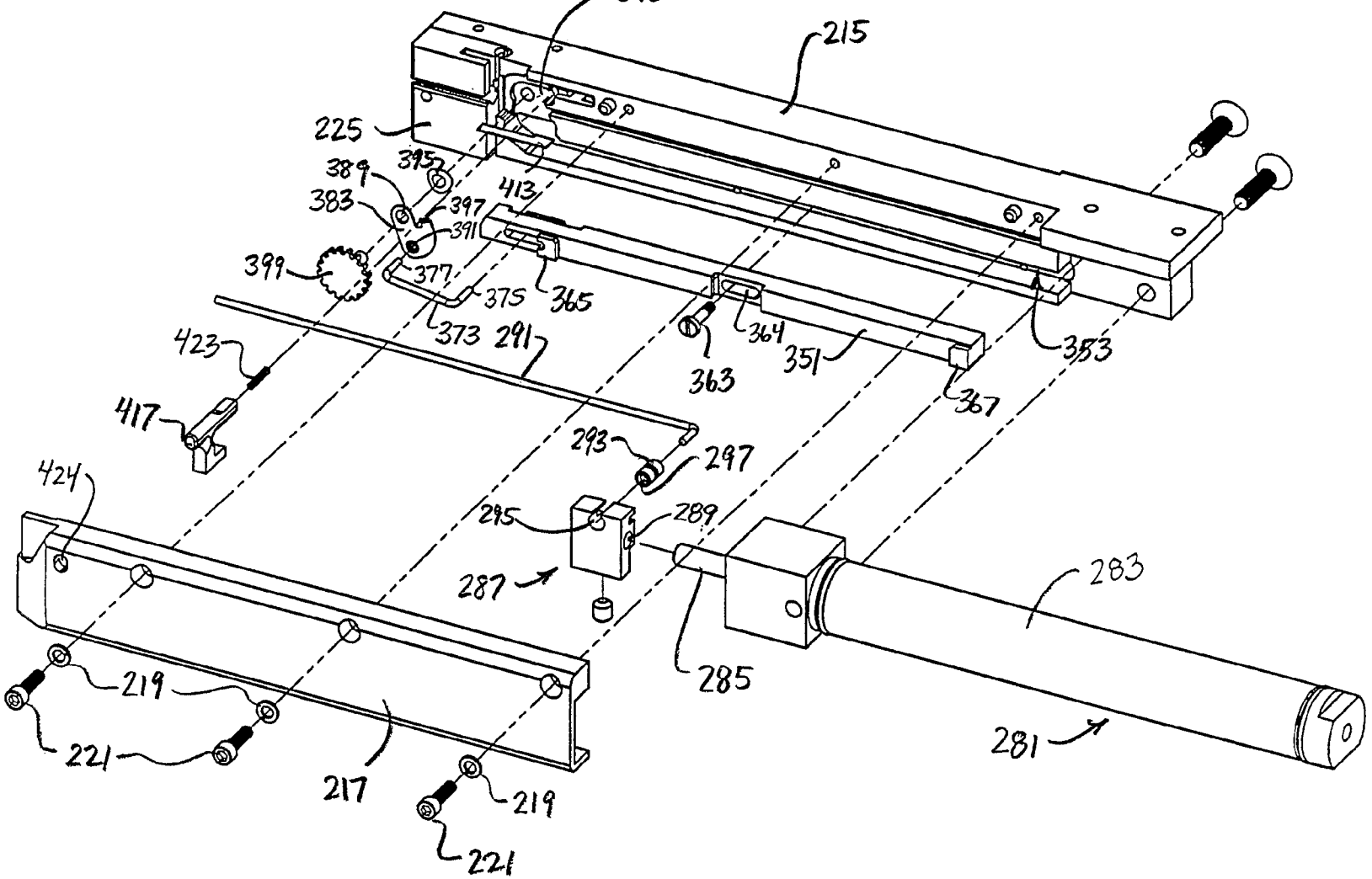
FIG. 5 is an exploded, front, top perspective view of selected components of the tool shown in FIG. 4(*a*)
Figure 10A:
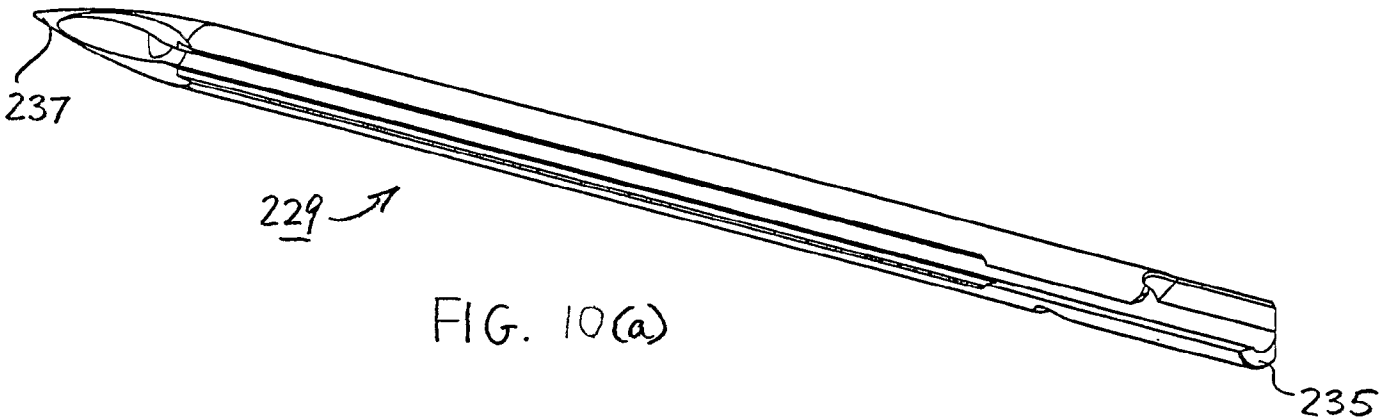
FIGS. 10(*a*)-(*c*) are perspective, top plan and front plan views, respectively, of the needle shown in FIG. 4(*a*)
Figure 10B:
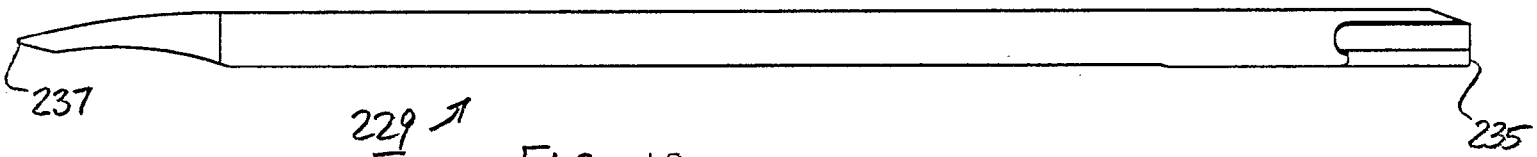
Figure 10C:
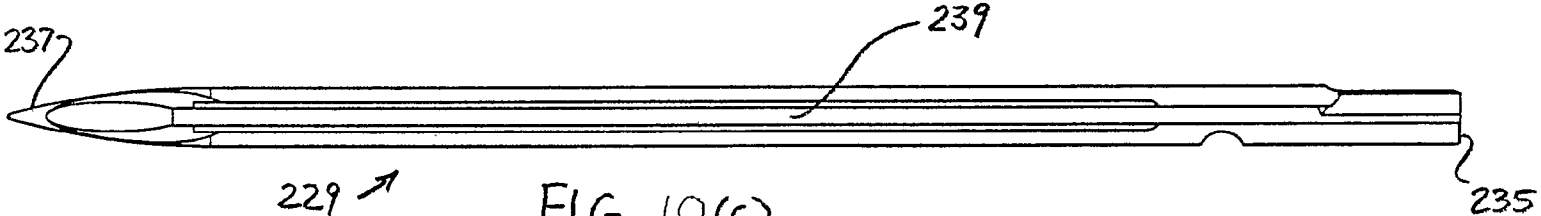

As seen most clearly in FIG. 5, housing 213 additionally includes a nose 225 (shown in isolation in FIGS. 9(*a*)-(*e*)) which is secured onto the leading end of right side casing 215 by a pair of screws. Nose 225 is shaped to define a longitudinal bore 227 which is adapted to receive an elongated, extra heavy-duty T-end, hollow, slotted needle 229 (shown in isolation in FIGS. 10(*a*)-(*c*)). A needle lock 231, which is represented in FIG. 4(*c*) as a fillister head screw, can be inserted into a transversely extending needle lock bore 233 in nose 225 in order to fix (i.e., lock) needle 229 in place within bore 227.

Needle 229 is manufactured to have a length which is considerably longer than other types of conventional extra heavy-duty T-end, hollow, slotted needles. Preferably, needle 229 is preferably approximately 3 inches in length, thereby enabling it to penetrate through all of layers 21-1, 23, 25, 27 and 29 of mattress 11. Needle 229 is similar to conventional slotted needles which are found in fastener dispensing tools in that needle 229 includes a trailing end 235, a leading end 237 in the form of a sharpened, spoon-shaped tip and a longitudinal bore 239 which is generally circular in lateral cross-section and extends the length of needle 229 from trailing end 235 to leading end 237. Bore 239 is sized and shaped to axially receive cross-bar 35 of fastener 31, thereby enabling cross-bar 35 to be inserted into bore 239 from trailing end 235, travel axially therethrough along its length and ultimately penetrate out from bore 239 through leading end 237.

It should be noted that tool 211 is specifically designed to receive needle 229 (which has a fixed length). In order to effectively change the length of needle 229, tool 211 is provided with a needle guard assembly 241 which can be slidably displaced relative to the leading end of housing 213, as will be described in greater detail below.

Figure 12:
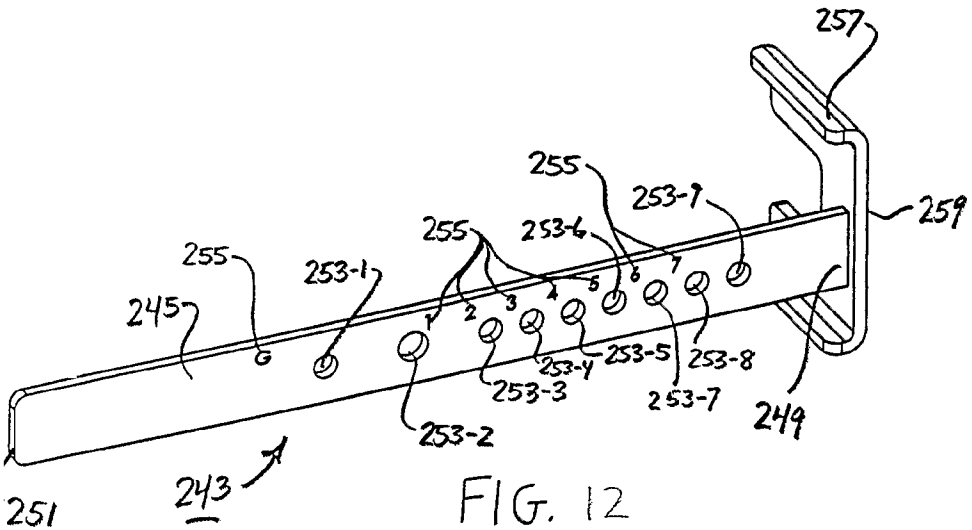
FIG. 12 is a rear, top perspective view of the needle guard shown in FIG. 11(*a*)
Figure 9A:
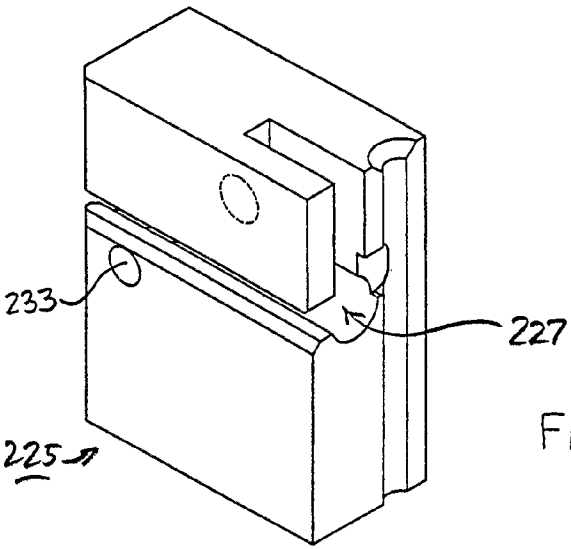
FIGS. 9(*a*)-(*e*) are perspective, top plan, front plan, right end plan and back plan views, respectively, of the nose of the tool shown in FIG. 5.
Figure 9B:
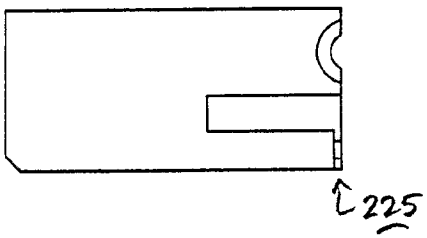
Figure 9E:
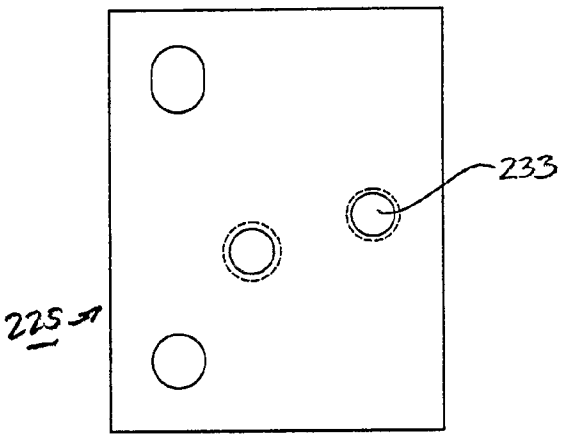
Figure 9D:
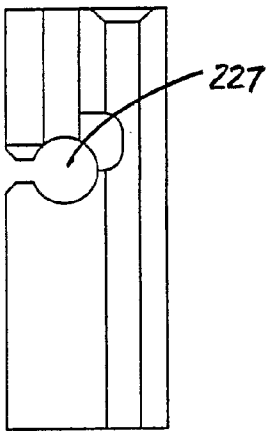
Figure 9C:
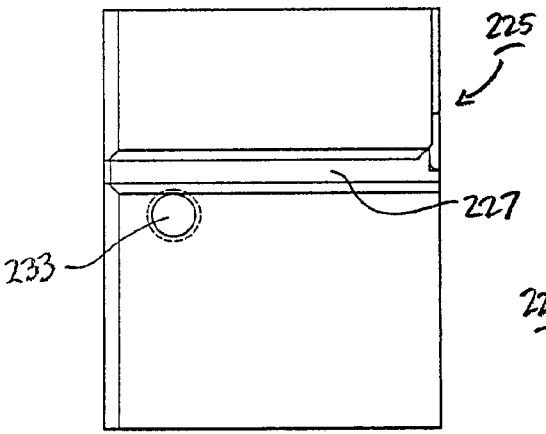
Figure 11:
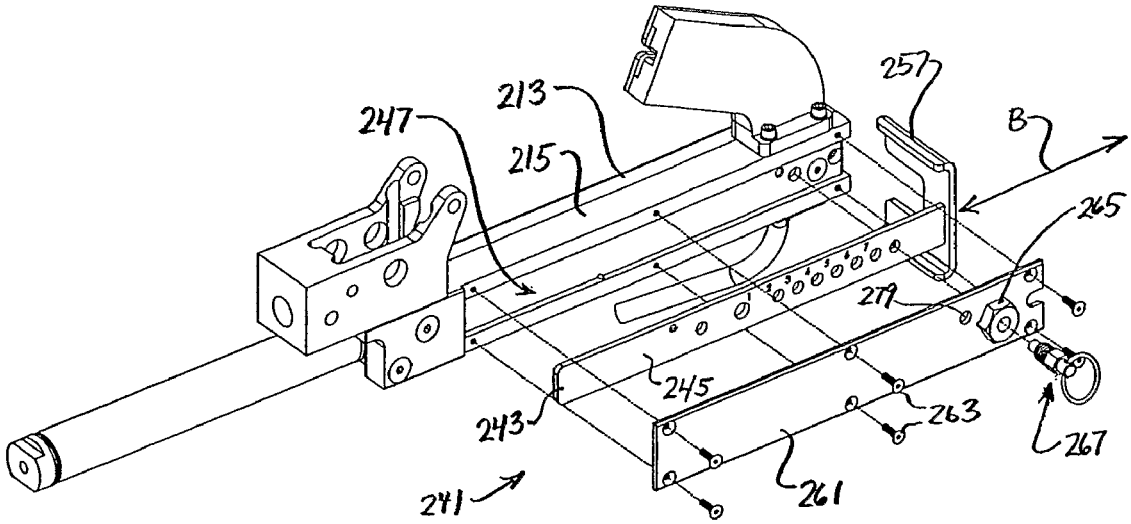
FIG. 11(*a*) is a partially exploded, rear, top perspective view of selected components of the tool shown in FIG. 4(*a*)
Figure 11:
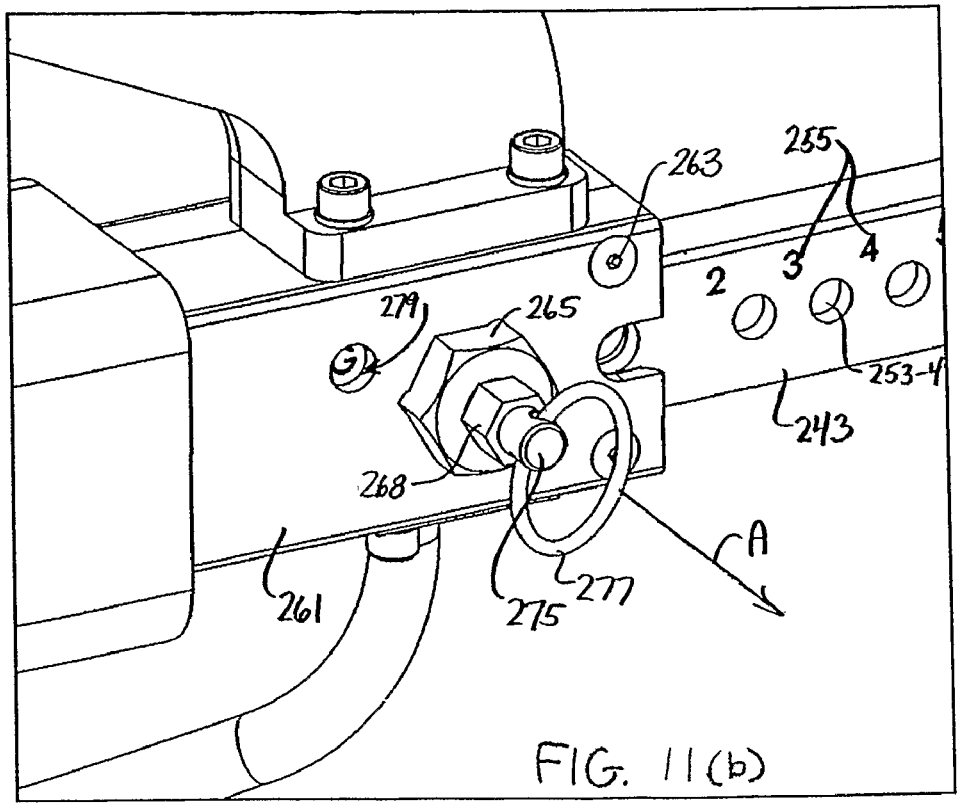

Specifically, as seen most clearly in FIGS. 11(*a*) and 11(*b*), needle guard assembly 241 comprises a needle guard 243 (shown in isolation in FIG. 12) which is slidably mounted onto the rear surface of right side casing 215. Needle guard 243 includes an elongated arm 245 which is sized and shaped to linearly slide within a shallow rectangular recess 247 formed in the rear surface of right side casing 215. Arm 245 is in the form of a flat, rectangular bar which includes a first end 249 and a second end 251. A plurality of circular holes 253-1 thru 253-9 are formed into arm 245 along its length. In addition, indicia 255 (represented herein as being in the form of the letter G and the sequence of numbers from 1 to 7) is provided onto the rear surface of arm 245 and provides the user with a visible marker as to the position of needle guard 243 relative to right side casing 215, as will be described further below.

Needle guard 243 additionally includes a U-shaped contact plate 257 which is formed onto first end 249 of arm 245 at a right angle relative thereto. Contact plate 257 includes a substantially flat contact surface 259 which is designed to press against the outer surface of the mattress through which fastener 31 is to be dispensed using tool 211. As can be appreciated, the ability to linearly slide needle guard 243 serves to displace contact plate 257 towards or away from the leading end of housing 213.

Figure 13:
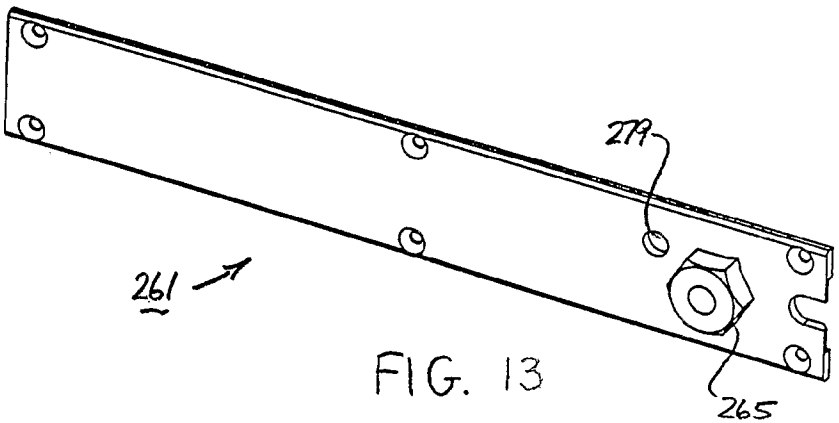
FIG. 13 is a rear, top perspective view of the back plate shown in FIG. 11(*a*)
Figure 14:
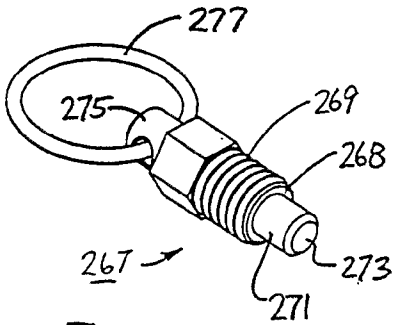
FIG. 14 is a front, top perspective view of the locking member shown in FIG. 11(*a*)

A substantially flat back plate 261 (shown in isolation in FIG. 13) is affixed by screws 263 to the rear surface of right side casing 215 over needle guard 243. In this manner, back plate 261 serves to retain arm 245 of needle guard 243 in place within recess 247. A raised, internally-threaded hex nut 265 is integrally formed onto the outer surface of back plate 261 and is adapted to threadingly receive locking member 267 (shown in isolation in FIG. 14).

Locking member 267 is in the form of a retractable spring plunger and comprises a hollow pin 268. The outer surface of pin 268 is shaped to include an outer threading 269 which is sized and shaped to engage the internal threading within hex nut 265. Accordingly, hollow pin 268 is designed to be securely affixed onto back plate 261 by driving outer threading 269 into engagement with the internal threading within hex nut 265, as seen most clearly in FIG. 11(*b*). A spring biased plunger 271 extends axially within hollow pin 268 and includes a first end 273 and a second end 275. A ring 277 is retained onto second end 275 of plunger 271 and serves as a means for pulling plunger 271 rearward. Specifically, it is to be understood that pulling ring 277 rearward (as represented by arrow A in FIG. 11(*b*) serves, in turn, to rearwardly displace first end 273. Upon the withdrawal of said rearward force, internal springs (not shown) within locking member 267 resiliently displace first end 273 of plunger 271 in the forward direction and back to its original position.

In this manner, needle guard assembly 241 can be used in the following manner to adjust the effective length of needle 229. By applying a rearward force onto ring 277 (as represented by arrow A in FIG. 11(*b*)), first end 273 of plunger 271 is rearwardly displaced in the direction away from needle guard 243. While maintaining said rearward force on ring 277, the user is able to linearly slide needle guard 243 within recess 247 (as represented by arrow B in FIG. 11(*a*)). As needle guard 243 is linearly displaced, each form of indicia 255 (i.e., each marker) on arm 245 sequentially aligns within a circular window 279 formed in back plate 261. In this manner, the sequential alignment of each piece of indicia 255 through window 279 serves as a visible marker to the user in indexing needle guard 243 among its fixed settings.

Once the user locates a particular desired setting (thereby signifying the desired position of needle guard 243 relative to right side casing 215), rearward force A on ring 277 is released which, in turn, causes spring biased plunger 271 to resiliently return to its original position. As plunger 271 returns to its original position, first end 273 fittingly penetrates into a corresponding hole 253 in arm 245 to effectively lock needle guard 243 in place, which is highly desirable.

It should be noted that tool 211 is designed such that the replacement and installation of needle 229 is to be effected with needle guard 243 disposed in its most extended setting (i.e., with the piece of indicia 255 identified by the letter G disposed within window 279 in back plate 261), this setting also serving as the guard (G), or protective, position since the sharpened tip of needle 229 is safely disposed behind contact plate 257, as seen most clearly in FIGS. 4(*a*) and 4(*b*). With needle guard 243 disposed in its most extended setting, opening 253-2 (which is larger in diameter than the remainder of openings 253) is positioned in direct axial alignment with needle lock bore 233 in nose 225. Accordingly, needle lock 231 (which has a head which is smaller in diameter than opening 253-2) can be inserted entirely through needle guard 243 and into needle lock bore 233 in nose 225 in order to fix (i.e., lock) needle 229 in place within bore 227. It should be noted that needle lock 231 fits entirely within needle lock bore 233 to as not to interfere with the ability to slide needle guard 243 within recess 247.

Indexing needle guard 243 (and, in particular contact plate 257) amongst the several fixed positions relative to housing 213 serves to change the effective length of needle 229. Specifically, adjusting needle guard 243 serves, in turn, to limit the portion of needle 229 which is able to penetrate through the one or more layers of material. As seen most clearly in FIG. 15, the effective length L of needle 229 is the distance from leading end 237 of needle 229 to contact surface 259 of contact plate 257. As a result, by displacing contact plate 257 out away from the front end of housing 213 (as represented by arrow C in FIG. 15), the effective length L of needle 229 is reduced, whereas by displacing contact plate 257 in towards the front end of housing 213 (as represented by arrow C' in FIG. 15), the effective length L of needle 229 is increased. As can be appreciated, the fact the effective length of needle 229 can be modified by the user without necessitating the removal and installation of various needles of different lengths (as is the case with tool 61) significantly simplifies the operation and construction of tool 211, which is highly desirable.

Tool 211 additionally comprises a pneumatically-driven ejection mechanism. Specifically, as seen most clearly in FIGS. 5, 16(*a*) and 16(*b*), tool 211 comprises a drive cylinder 281 (shown in isolation in FIG. 17) which is pneumatically driven, drive cylinder 281 comprising an air chamber 283 and a push rod 285 which is telescopingly mounted within air chamber 283 and is adapted for axial displacement relative thereto.

Figure 8:
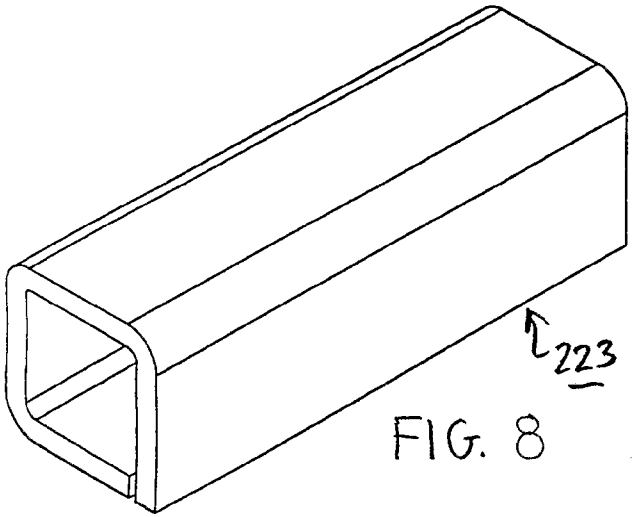
FIG. 8 is an enlarged rear, bottom perspective view of the handle shown in FIG. 4(*a*)

A slide 287 (shown in isolation in FIGS. 8(*a*) and 8(*b*)) is fixedly mounted onto the free end of push rod 285. Specifically, slide 287 is shaped to include a longitudinally extending bore 289 which is sized and shaped to fittingly receive the free end of push rod 285 (with an adhesive preferably deposited within bore 289 to secure slide 287 on push rod 285). In this manner, the activation and deactivation of drive cylinder 281 serves to longitudinally displace push rod 285 and, in turn, slide 287.

An L-shaped ejector rod 291 is fixedly mounted onto slide 287 by means of a pin 293. Specifically, pin 293 is fittingly disposed into a laterally extending bore 295 formed in slide 287. In turn, ejector rod 291 is fittingly mounted into a longitudinal bore 297 formed in pin 293, a portion of the length of ejector rod 291 extending through a longitudinal, rectangular notch 299 formed in slide 287.

As can be appreciated, the activation and deactivation of drive cylinder 281 serves to longitudinally displace slide 287 which, in turn, linearly advances ejector rod 291 through tool 211. In particular, ejector rod 291 is aligned to selectively protrude axially through longitudinal bore 239 in needle 229 so as to expel the cross-bar 35 of a fastener 31 out through the open tip of needle 229, as will be described further below.

Figure 21:
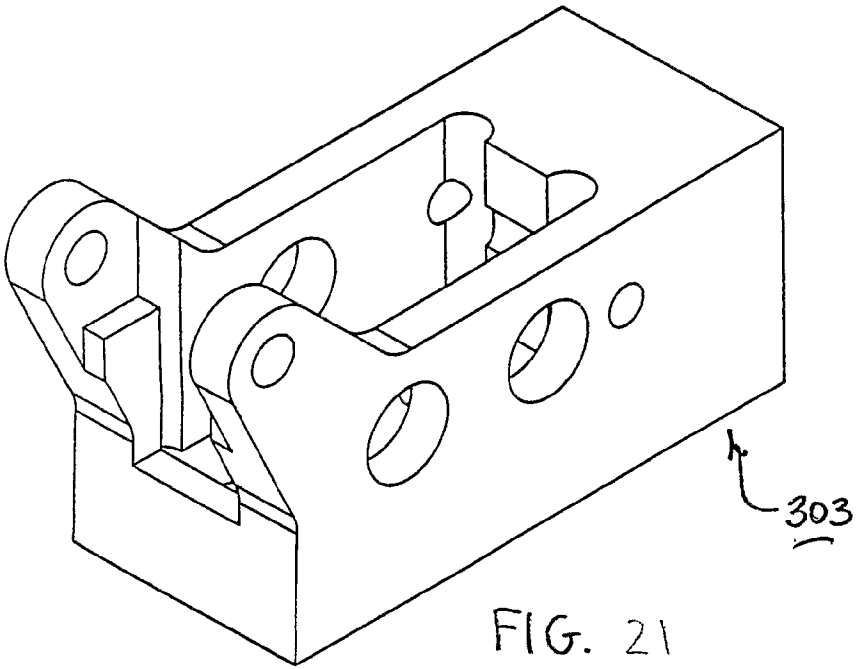
FIG. 21 is an enlarged, front, top, left end perspective view of the valve support block shown in FIG. 19.
Figure 25:
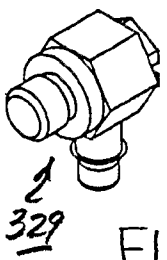
FIG. 25 is an enlarged perspective view of one of the universal fittings shown in FIG. 19.

It should be noted that the activation and deactivation of drive cylinder 281 is controlled through a finger operable valve assembly 301. As seen most clearly in FIGS. 4(*a*)-(*e*), 19 and 20, valve assembly 301 comprises a valve support block 303 (shown in isolation in FIG. 21) which is secured onto the trailing end of right side casing 215 using the combination of a lock washer 305 and a socket head cap screw 307 at two separate locations.

Figure 22:
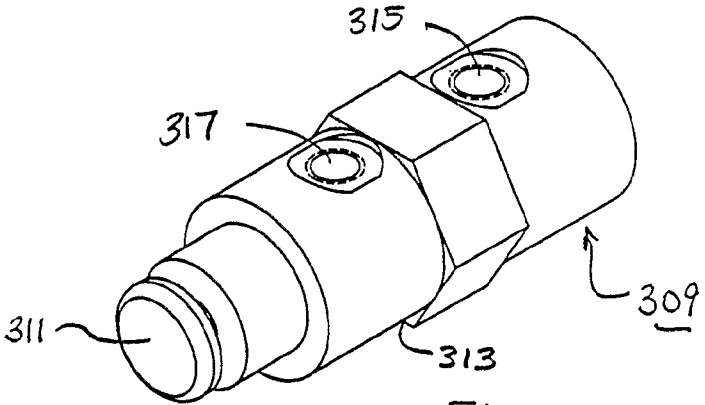
FIG. 22 is an enlarged, front, bottom, left end perspective view of the four-way valve shown in FIG. 19.

Valve assembly 301 additionally includes a four-way valve 309 (shown in isolation in FIG. 22) which is fittingly disposed within valve support block 303. As will be described further below, four-way valve 309 is adapted to receive air pressure from a heavy duty air supply (not shown) and, in turn, selectively route said air pressure to air chamber 283 in order to drive push rod 285 in either of two opposing directions. Four-way valve 309 includes an actuation button, or piston, 311, an input valve 313, a first output valve 315 and a second output valve 317, each of valves 313, 315 and 317 having a size of 10/32 NPT.

Actuation button 311 serves as a finger-actuable input means for controlling the operation of four-way valve 309. As seen most clearly in FIG. 4(*c*), an L-shaped trigger 319 (shown in isolation in FIG. 23) is pivotally mounted onto valve support block 303 about a pin 321, wherein a pair of C-shaped clamps 323 are mounted onto opposite ends of pin 321 in order to retain trigger 319 on pin 321. A trigger cover 325 is slidably mounted over a portion of trigger 319 and serves to provide a comfortable surface to manipulate L-shaped trigger 319. As can be appreciated, trigger 319 is pivotally mounted onto support block 303 such that a downward force applied onto trigger cover 325 (e.g., by a finger) in turn draws trigger 319 into contact against and inwardly displaces piston 311 of valve 309.

Figure 20:
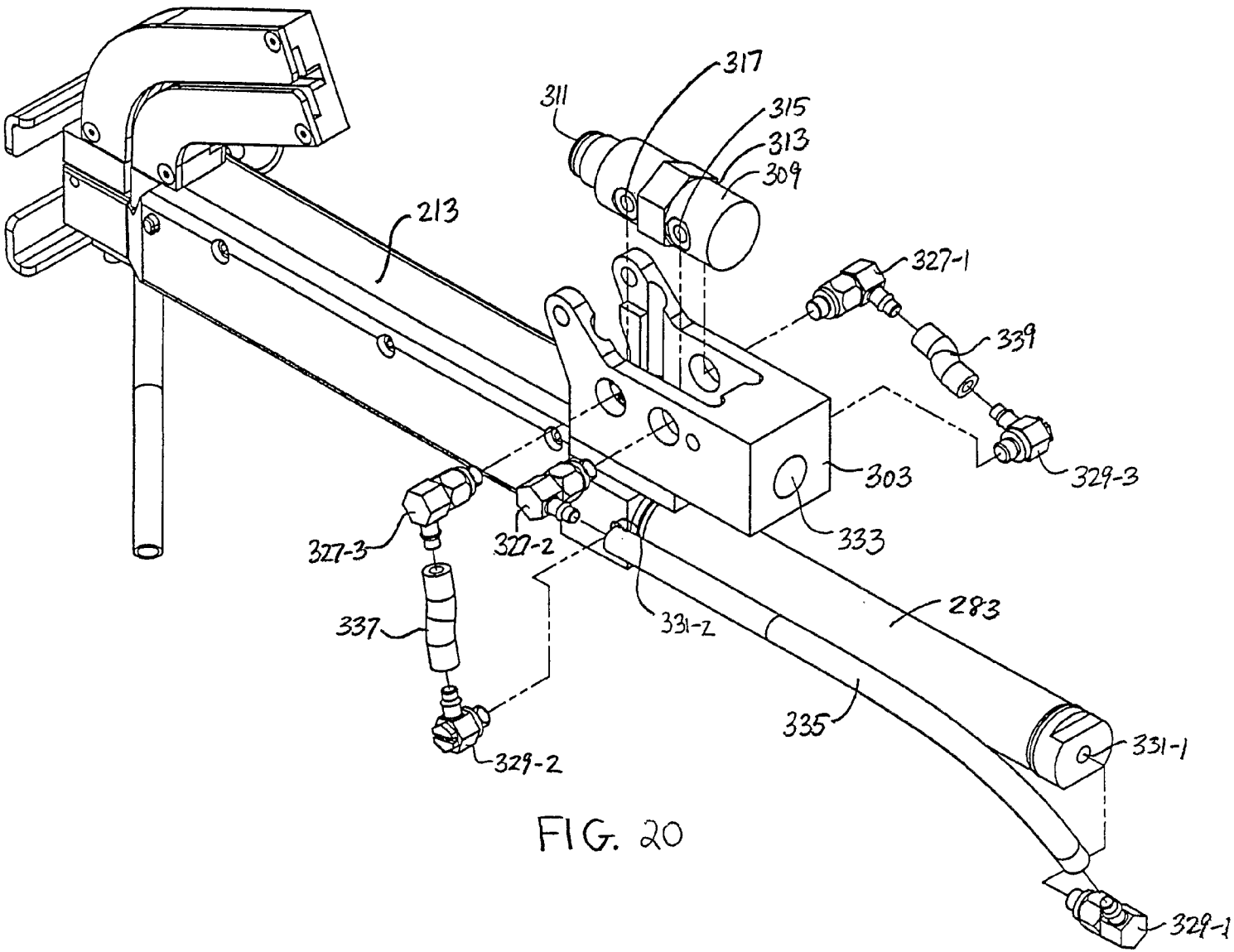
FIG. 20 is a partially exploded, front top perspective view of selected components of the tool shown in FIG. 4(*a*)
Figure 24:
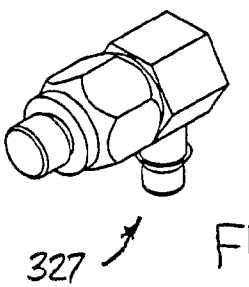
FIG. 24 is an enlarged perspective view of one of the swivel fittings shown in FIG. 19.

As seen most clearly in FIG. 20, swivel fittings 327-1, 327-2, and 327-3 (one fitting 327 being shown in isolation in FIG. 24) are disposed through openings in valve support block 303 and into communication with input valve 313, first output valve 315 and second output valve 317, respectively, of four-way valve 309. In addition, universal fittings 329-1 and 329-2 (one fitting 329 being shown in isolation in FIG. 29) are disposed into communication with first and second input valves 331-1 and 331-2, respectively, for air chamber 283. Furthermore, an additional universal fitting 329-3 is mounted in valve support block 303 in fluid communication with a 1/8 NPT-sized, heavy duty hose input valve 333 which is provided in the rear of valve support block 303.

A first length of ⅛ inch inner diameter hose 335 connects universal fitting 329-1 to swivel fitting 327-2. A second length of ⅛ inch inner diameter hose 337 connects swivel fitting 327-3 to universal fitting 329-2. A third length of ⅛ inch inner diameter hose 339 connects universal fitting 329-3 to swivel fitting 327-1.

As can be appreciated, a pneumatic power source can be coupled to valve assembly 301 in the following manner in order to provide power to tool 211. Specifically, a length of tubing from a heavy duty pneumatic power source (not shown) is coupled directly to the large sized input valve 333 in valve support block 303. It should be noted that the relatively large size of input valve 333 allows for a ¼ inch inner diameter high volume hose to be directly connected to tool 211. The ability to directly connect a large, high volume hose to tool 211 serves to significantly improve the overall durability and strength of the connection between the high volume hose and tool 211, which is highly desirable. Together, fittings 327-1 and 329-3, support block 303 and hose 339 serve to convert (i.e., ratchet down) the relatively large inner diameter size of the input tubing down to a diameter which is compatible with input valve 313 of four-way valve 309, which is highly desirable.

With the power source properly coupled to input valve 333, the application of a downward force onto trigger 319 serves to inwardly displace activation button 311 on valve 309. Activation of button 311 causes four-way valve 309 to route air pressure supplied from the power source out through output valve 315, through tubing 335 and into input valve 331-1 of air chamber 283. The input of air pressure into input valve 331-1 advances push rod 285 out from air chamber 283 which, in turn, urges ejector rod 291 through needle 229 (i.e., to eject the cross-bar 35 of a fastener 31 out through needle 229).

Upon the release of the downward force onto trigger 319, four-way valve 309 directs air pressure supplied from the power source out through output valve 317, through tubing 337 and into input valve 331-2 of air chamber 283. The input of air pressure into input valve 331-2 retracts push rod 285 back into air chamber 283 which, in turn, withdraws ejector rod 291 from needle 229.

As described above, valve assembly 301 is used to control the operation of drive cylinder 281 which, in turn, controls the operation of the ejection mechanism for tool 211. It should be noted that tool 211 is provided with a fixed-length ejection stroke. Stated another way, for each ejection stroke, ejector rod 291 travels a constant distance. Because the effective length L of needle 229 can be adjusted by simply sliding needle guard 243 (as described in detail above), the length of the ejection stroke does not need to be adjusted for tool 211. Rather, tool 211 operates with a constant ejection stoke length regardless of the effective length of needle 229. As can be appreciated, the ability of tool 211 to effectively change the length of needle 229 without necessitating a corresponding change in the ejection stroke length serves to significantly simplify the construction and operation of tool 211, which is highly desirable.

Figure 26:
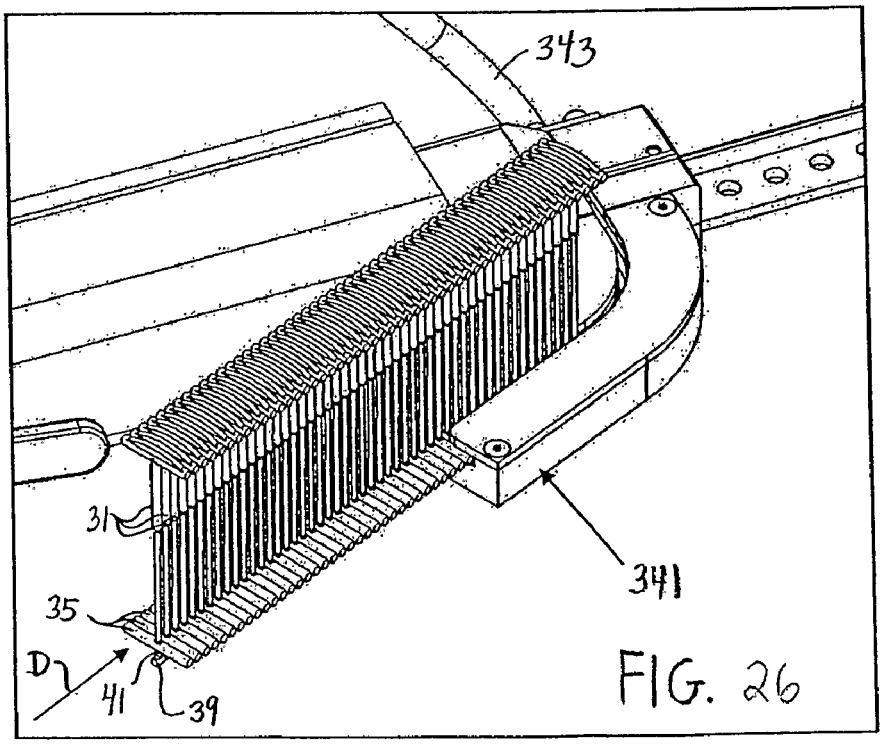
FIG. 26 is an enlarged, fragmentary, top, front perspective view of the tool shown in FIG. 4(*a*), the tool being shown with a clip of fasteners being loaded therein.

Tool 211 additionally includes means for guiding a fastener clip into and through tool 211 in such a manner so that the fastener clip is continuously directed away from the mattress to be fastened, which is highly desirable. Specifically, as seen most clearly in FIGS. 15, 19 and 26, tool 211 is provided with a fastener guide assembly 341 for guiding a clip of fasteners 31 into tool 211 and a runner bar guide 343 for guiding the used runner bar 39 from said clip out from tool 211.

Figure 27:
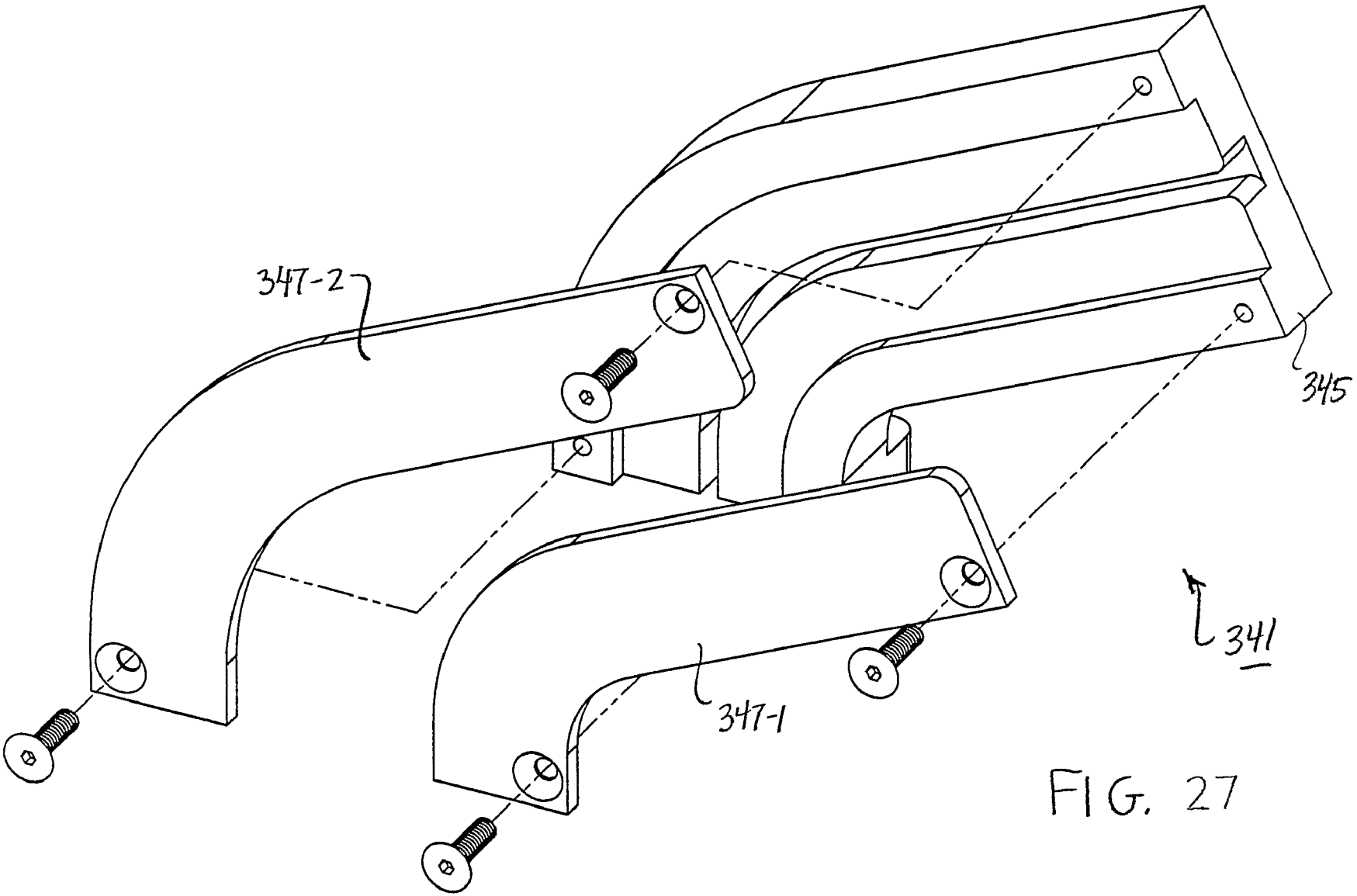
FIG. 27 is an enlarged, front perspective view of the fastener guide assembly shown in FIG. 4(*a*)

Fastener guide assembly 341 (shown in isolation in FIG. 27) comprises a fastener guide 345 which is secured onto the leading end of right side casing 215 using the combination of a lock washer 305 and a socket head cap screw 307 at two separate locations. Fastener guide assembly 341 additionally includes a pair of guide covers 347-1 and 347-2 which together define a partially enclosed channel 349 for receiving runner bar 39, necks 41 and cross-members 35 of the fastener clip, as seen most clearly in FIG. 26. It should be noted that fastener guide assembly 341 is provided with a curved construction in order to maintain the clip of fasteners 31 adequately away from the mattress to be fastened, as seen most clearly in FIG. 15.

Figure 19:
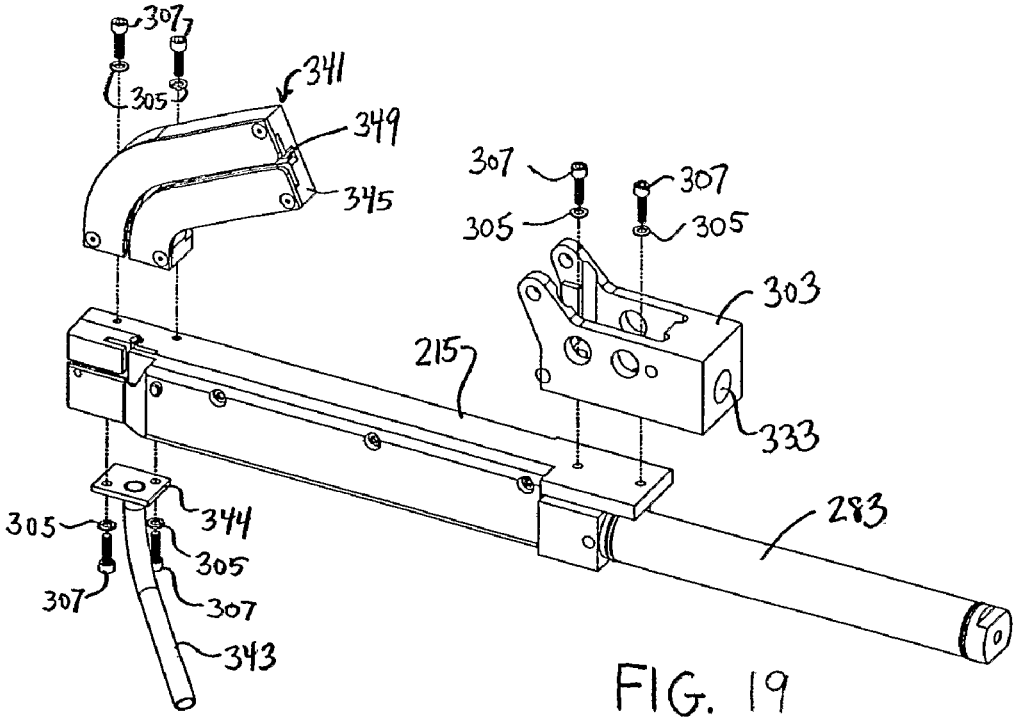
FIG. 19 is a partially exploded, front, top perspective view of selected components of the tool shown in FIG. 4(*a*)

Runner bar guide 343 is in the form of an elongated, curved, tube which is formed onto a flat plate 344 which, in turn, is fixedly secured onto right side casing 215 and nose 225 using the combination of a lock washer 305 and a socket head cap screw 307 at two separate locations, as seen most clearly in FIG. 19. Runner bar guide 343 is sized and shaped to receive runner bar 39 after fastener 31 has been dispensed from the fastener clip. In this manner, the curved construction of guide 343 serves to direct a used runner bar 39 away from the item to be fastened (i.e., the mattress), as seen most clearly in FIG. 15.

Figure 15:
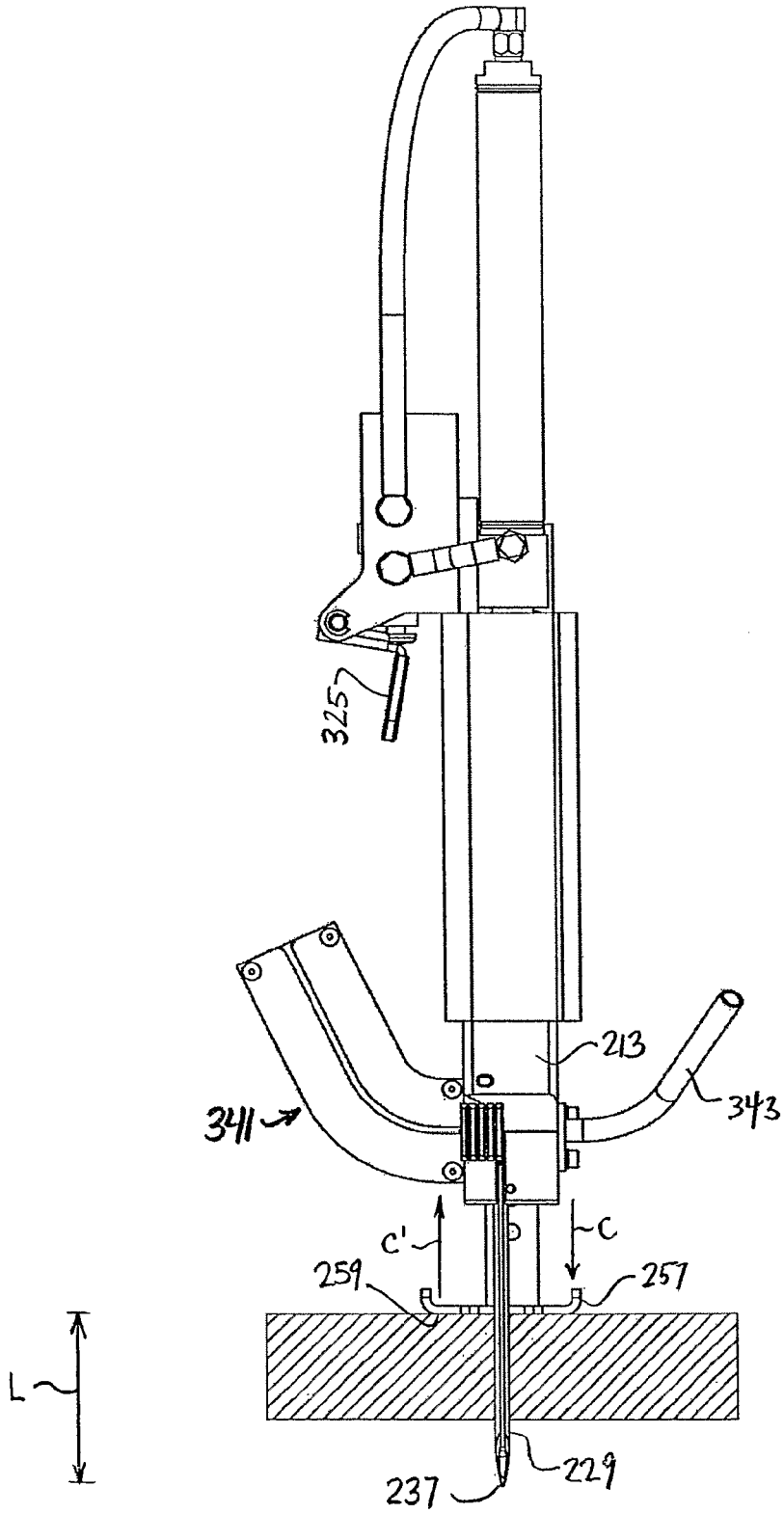
FIG. 15 is a front plan view of the tool shown in FIG. 4(*a*), the tool being shown with a clip of five fasteners loaded therein, the tool being shown driven through a mattress, the mattress being shown in section for purposes of clarity.
Figure 16:
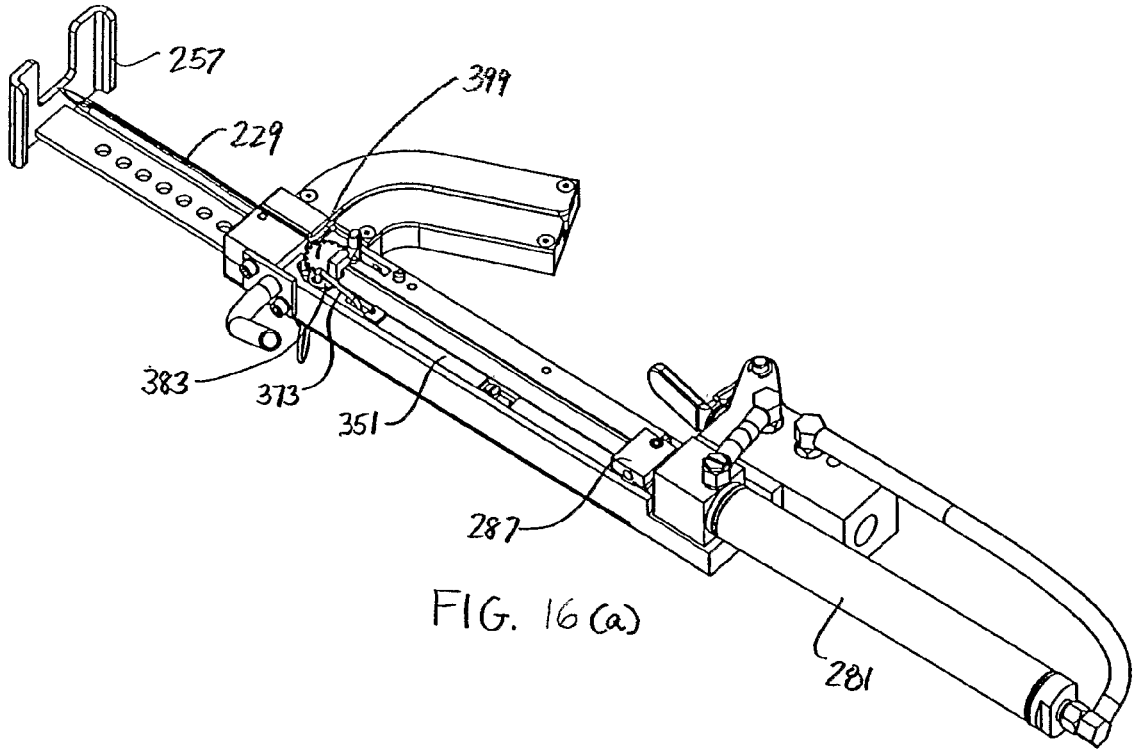
FIGS. 16(*a*)-(*b*) are front, bottom perspective and front, top perspective views, respectively, of the tool shown in FIG. 4(*a*), the tool being shown with the left side casing removed therefrom.
Figure 16:
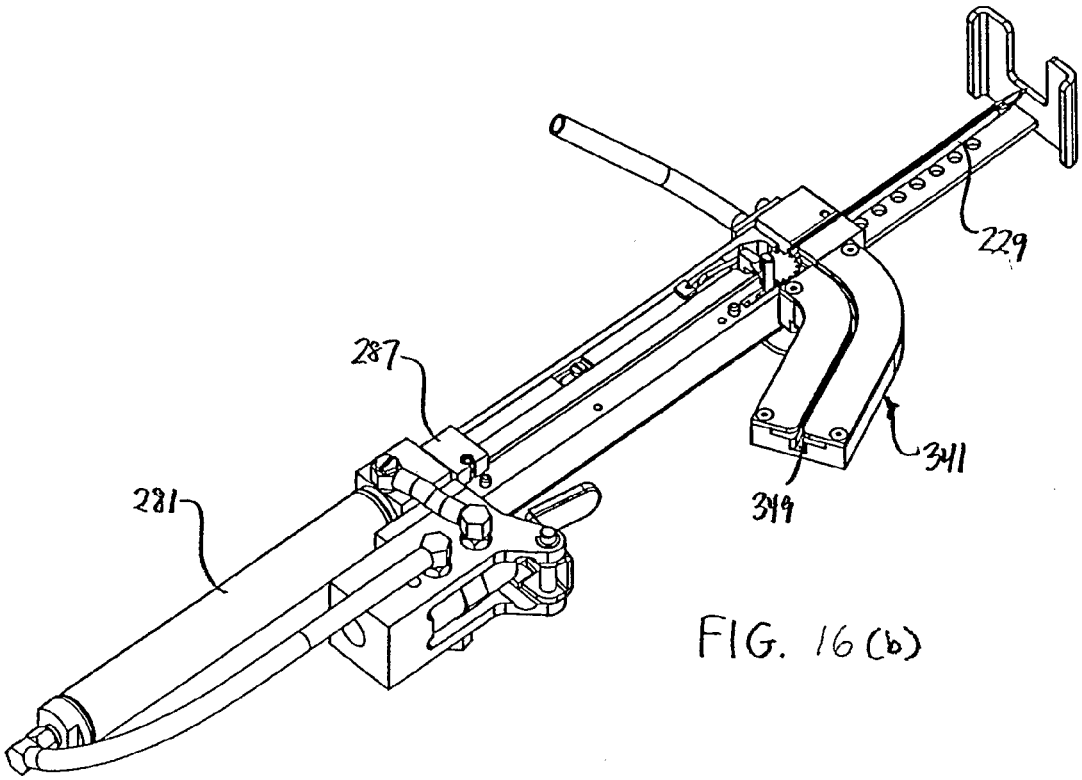
Figure 17:
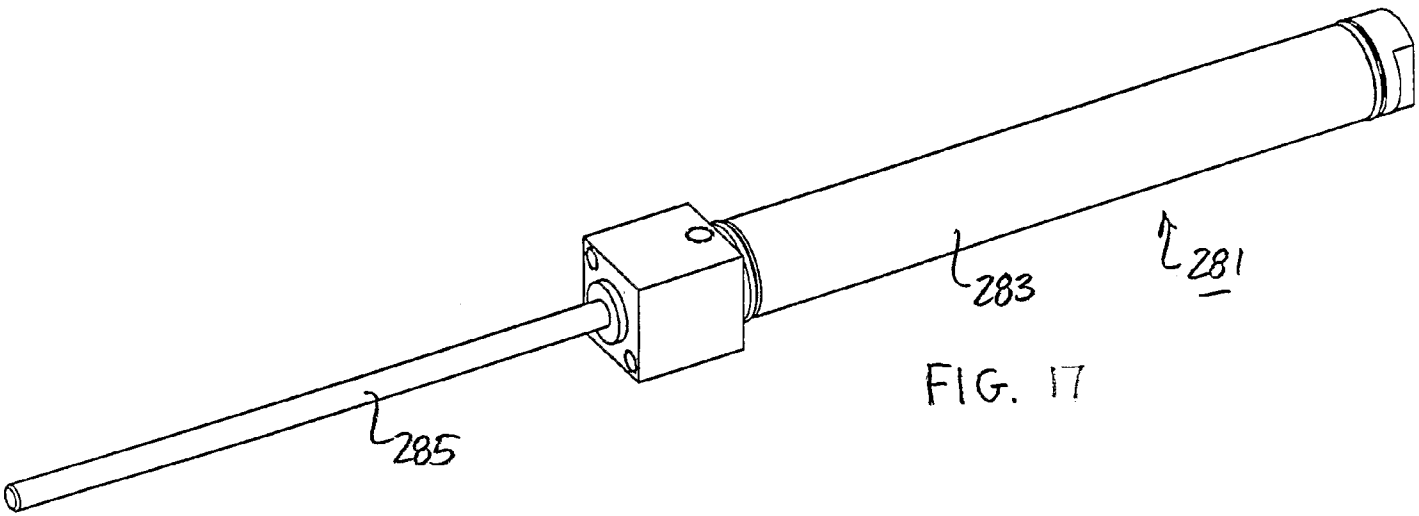
FIG. 17 is a front, top perspective view of the drive cylinder shown in FIG. 5.
Figure 18B:
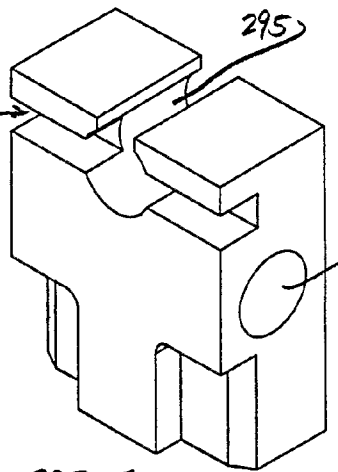
FIGS. 18(*a*)-(*b*) are front, top, right end perspective and rear, top, left end perspective views, respectively, of the slide shown in FIG. 5.
Figure 18A:
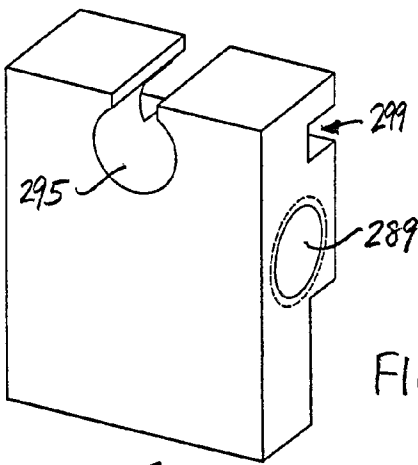

As seen most clearly in FIGS. 15, 16(*a*) and 16(*b*), tool 211 is provided with an indexing mechanism for advancing the lowermost fastener 31 in the clip in place behind needle 229 prior to the ejection process. It should be noted that the indexing mechanism for tool 211 is coupled to its ejection mechanism, thereby simplifying the operation of tool 211, which is highly desirable.

Figure 28:
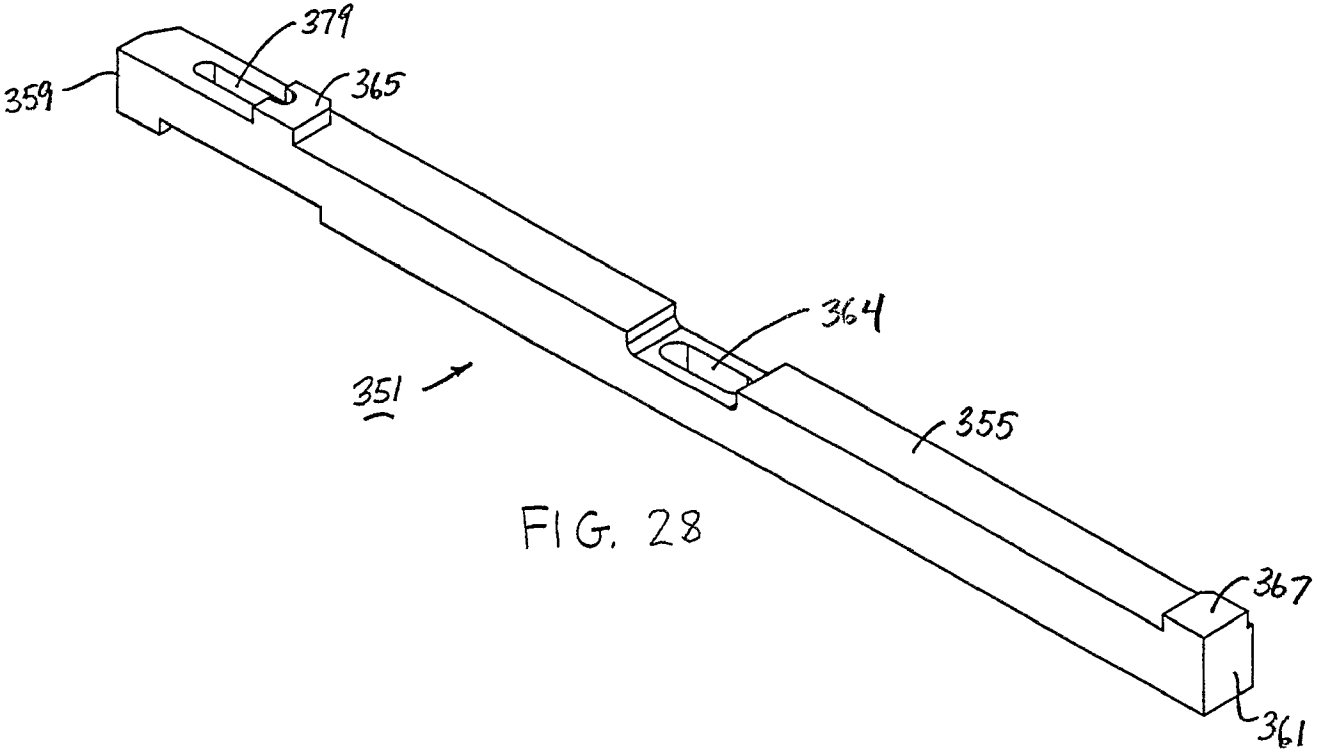
FIG. 28 is an enlarged, front, bottom perspective view of the index slide shown in FIG. 5.

The indexing mechanism comprises an elongated index slide 351 (shown in isolation in FIG. 28) which is disposed within an index slide cavity 353 formed in right side casing 215, index slide 351 including a front surface 355, a rear surface 357, a first end 359 and a second end 361. Index slide 351 is adapted to slide linearly within cavity 353, as will be described further below. A screw 363 extends through a slot 364 formed in slide 351 and into threaded engagement within a bore formed in right side casing 215, screw 363 serving to retain index slide 351 within cavity 353 without limiting its linear displacement. A forward projection 365 and a rearward projection 367 are formed onto front surface 355 at opposite ends of index slide 351.

Figure 31:
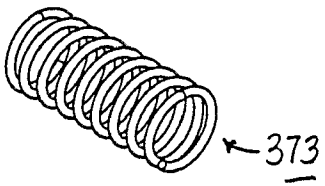
FIG. 31 is an enlarged perspective view of one of the springs shown in FIG. 29.
Figure 30:
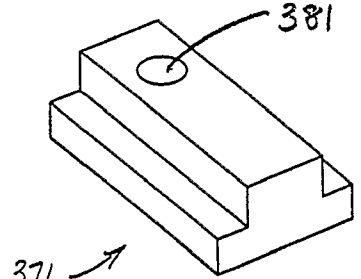
FIG. 30 is an enlarged, front, top, left end perspective view of the tab shown in FIG. 29.
Figure 29:
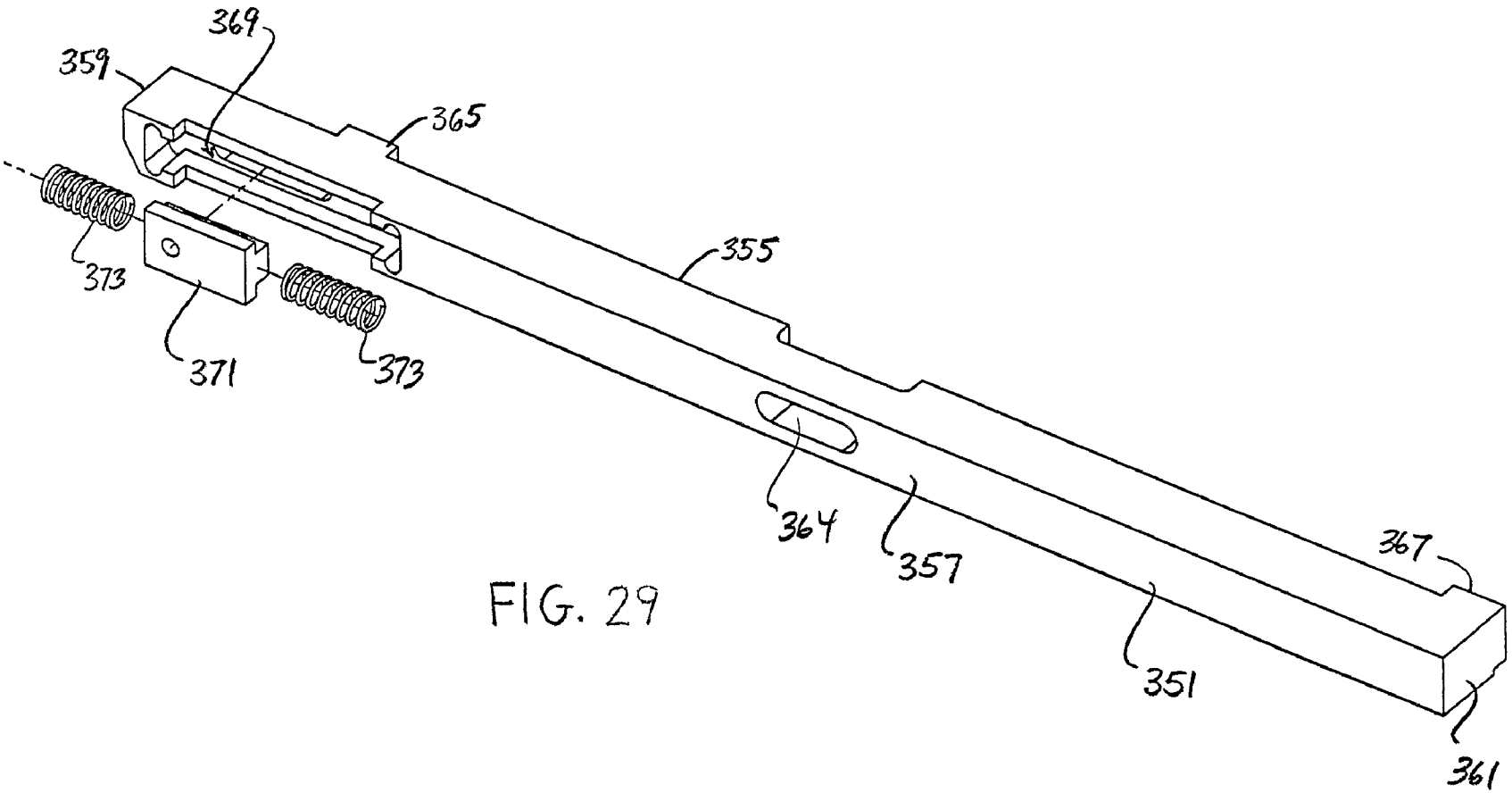
FIG. 29 is an enlarged, rear, top perspective view of the index slide, tab and pair of springs shown in FIG. 5.

As seen most clearly in FIG. 29, a groove 369 is formed into rear surface 357 of index slide proximate first end 359. A tab 371 (shown in isolation in FIG. 30) is slidably disposed within groove 369 and is biased by a pair of springs 373 (one spring 373 being shown in isolation in FIG. 31). Specifically, tab 371 and springs 373 are linearly disposed within groove 369 with tab 371 sandwiched between springs 373. In this manner, tab 371, in the absence of any substantial outside force, aligns in the center of groove 369. However, upon the application of a lateral force, one spring 373 will compress which, in turn, allows for tab 371 to displace slightly within groove 369.

Figure 32:
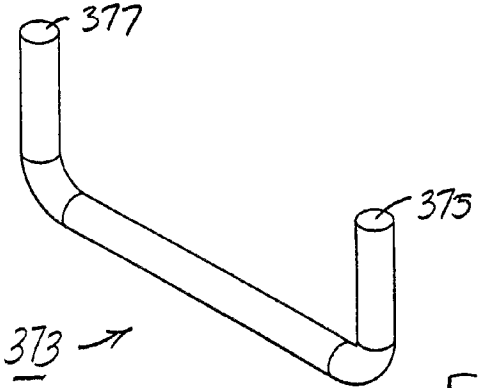
FIG. 32 is an enlarged, front, top, right end perspective view of the index link shown in FIG. 5.
Figure 35A:
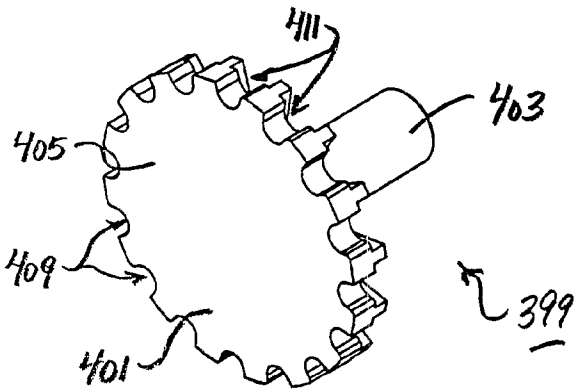
FIGS. 35(*a*)-(*d*) are perspective, front plan, right end plan and rear plan views, respectively, of the sprocket shown in FIG. 5.
Figure 35B:
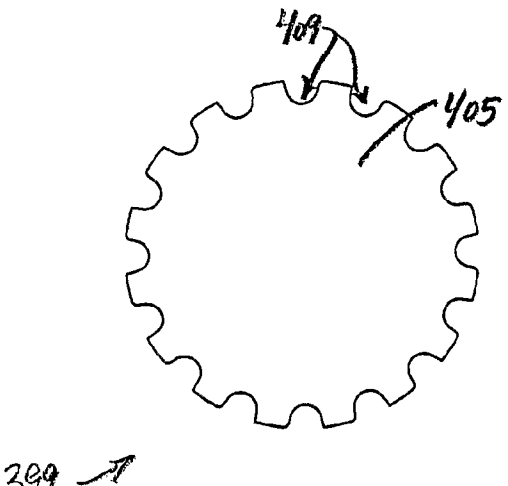
Figure 35C:
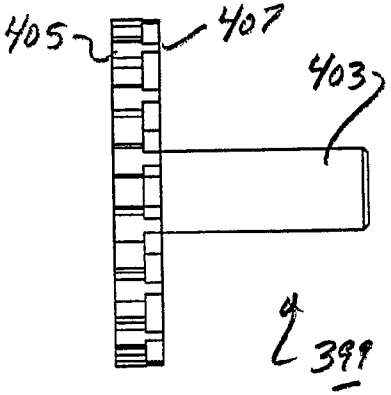
Figure 35D:
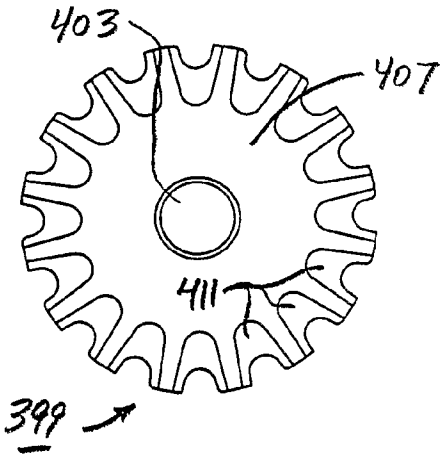

A U-shaped index link 373 (shown in isolation in FIG. 32) includes a first end 375 and second end 377. First end 375 is disposed through a slot 379 formed in index slide 351 and fittingly protrudes into a bore 381 in tab 371. Second end 377 of index link 373 is coupled to an index pawl 383.

Figure 33:
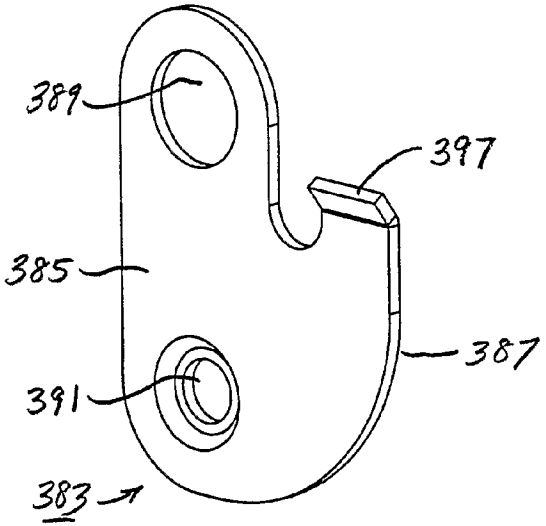
FIG. 33 is an enlarged, front perspective view of the index pawl shown in FIG. 5.
Figure 34:
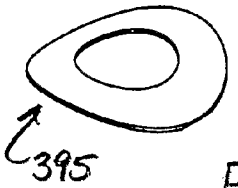
FIG. 34 is an enlarged, front perspective view of the bowed washer shown in FIG. 5.

Index pawl 383 (shown in isolation in FIG. 33) is a unitary member which includes a substantially flat front surface 385, a substantially flat rear surface 387, an opening 389 and a bore 391 which is sized and shaped to fittingly receive second end 377 of index link 373. Index pawl 383 is pivotally disposed within a shallow recess 393 formed in right side casing 215. A bowed washer 395 (shown in isolation in FIG. 34) is disposed between right side casing 215 and rear surface 387 and serves to space index pawl 383 slightly away from right side casing 215. A ratchet-shaped tooth 397 is projects up from front surface 385 and serves to sequentially engage notches formed on a sprocket 399.

Sprocket 399 (shown in isolation in FIGS. 35(*a*)-(*d*)) includes a disc-shaped member 401 and a post 403. Post 403 is sized and shaped to penetrate through opening 389 in index pawl 383 and into a bore 405 formed in right side casing 215. In this manner, sprocket 399 can be rotated relative to right side casing 215 about post 403. Disc-shaped member 401 includes a flat front surface 405 and a flat rear surface 407. A first set of notches 409 are formed into front surface 405 along the outer periphery of member 401. In addition, a second set of notches 411 (notches 411 extending deeper than notches 409) are formed into rear surface 407 along the outer periphery of member 401.

Figure 37:
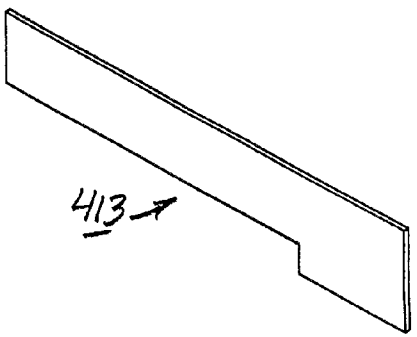
FIG. 37 is a bottom perspective view of the detent shown in FIG. 5.
Figure 36A:
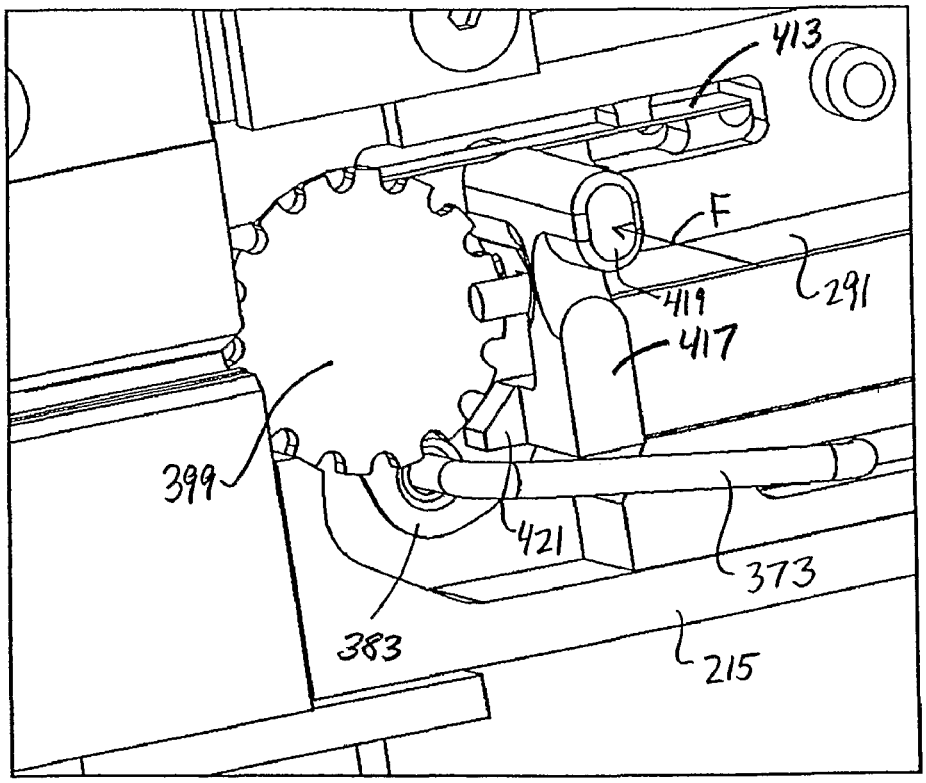
FIG. 36(*a*) is an enlarged, fragmentary, front perspective view of leading end of the tool shown in FIG. 16(*a*).
Figure 36B:
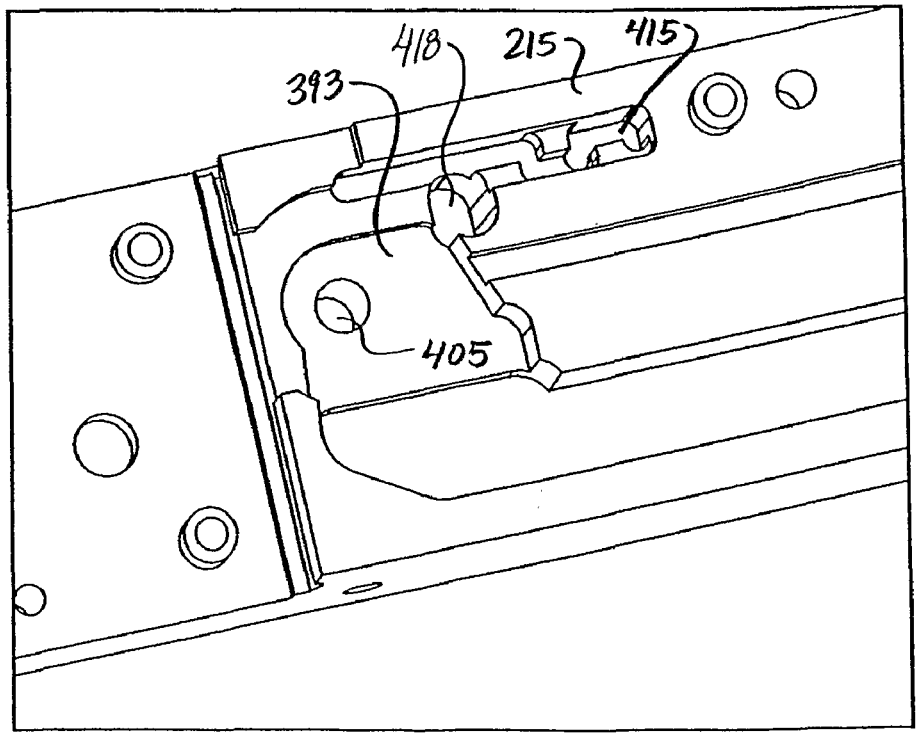
Figure 38C:
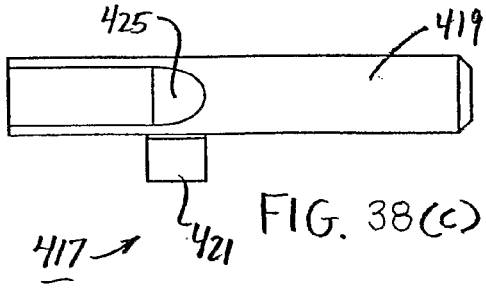
FIGS. 38(*a*)-(*e*) are perspective, left end plan, top plan, rear plan and front plan views, respectively, of the release button shown in FIG. 5.
Figure 38D:
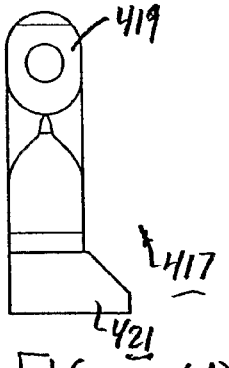
Figure 38B:
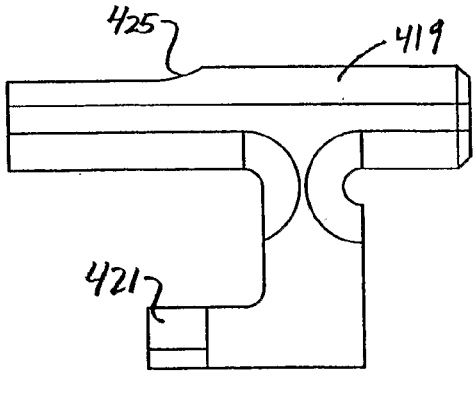
Figure 38E:
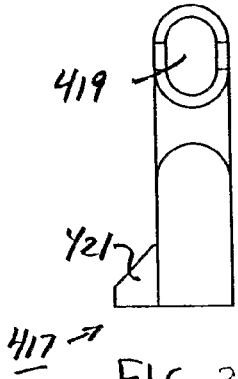
Figure 38A:
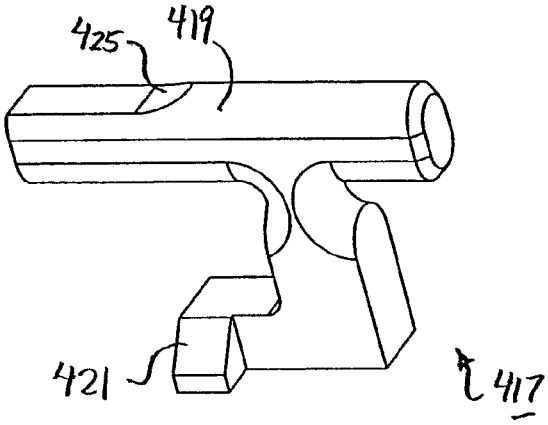

As seen most clearly in FIG. 36(*a*), a flexible detent 413 (shown in isolation in FIG. 37) is fixedly secured at one end within a detent recess 415 formed in right side casing 215. In addition, a release button 417 (shown in isolation in FIGS. 38(*a*)-(*e*)) is mounted over index pawl 383 and at least partially protrudes into a groove 418 formed in right side casing 215. Specifically, release button 417 is an integral member which includes a hammer 419 which is generally oval in lateral cross-section and an arm 421. Release button 417 is mounted such that one end of hammer 419 fittingly protrudes into groove 418 with a release button spring 423 being disposed therebetween to continuously urge hammer 419 away from right side casing 215. The opposite end of hammer 419 is sized and shaped to penetrate through an opening 424 in left side casing 217, thereby rendering a portion of hammer 419 externally accessible, as seen in FIG. 4(*a*). With release button 417 mounted as such, arm 421 lies in contact against top surface of index pawl 383, as seen in FIG. 36(*a*).

The indexing mechanism for tool 211 operates in the following manner to sequentially index the lowermost fastener 31 in the supply of fastener stock into alignment behind the longitudinal bore of needle 229 prior to the ejection process. Specifically, the supply of fastener stock is loaded, by hand, into enclosed channel 349 of fastener guide assembly 341 (as represented by arrow D in FIG. 26). The supply of fastener stock is fed into tool 211 until the severable connector 41 associated with the lowermost fastener 31 in the fastener stock aligns within a corresponding notch 409 in sprocket 399. With the supply of fastener stock fed into tool 211 in this manner, the cross-bar 35 of the lowermost fastener 31 is disposed in direct axial alignment behind longitudinal bore 239 of needle 229.

The activation of drive cylinder 281 by means of valve assembly 301 serves to displace slide 287 linearly forward along front surface 355 of index slide 351. As part of the ejection process (which is described in detail above), forward travel of slide 287, in turn, displaces ejector rod 291 forward. As ejector rod 291 travels forward, ejector rod 291 contacts the cross-bar 35 of the lowermost fastener 31 and advances it out through the sharpened tip of needle 229.

Figure 39:
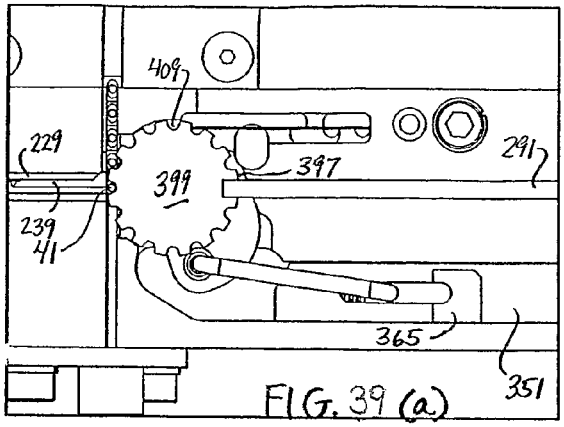
FIGS. 39(*a*)-(*e*) are enlarged, fragmentary, front plan views of the tool shown in FIG. 4(*a*) at various stages during the process of indexing a fastener into position for ejection, said tool being shown with its left side casing removed therefrom.
Figure 39:
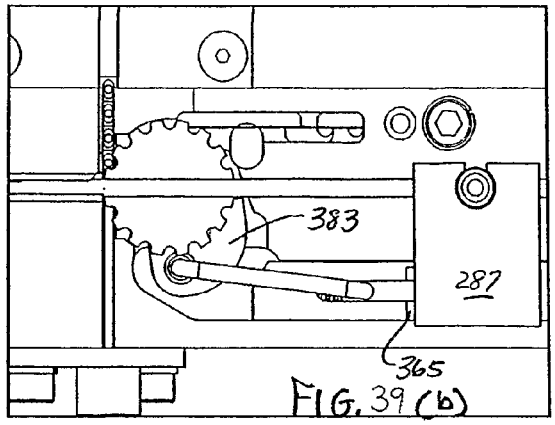
Figure 39:
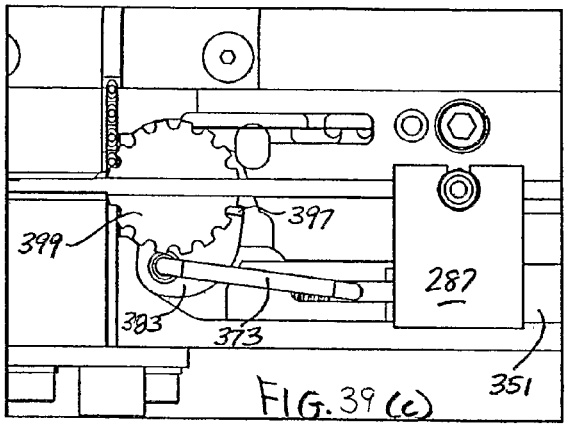
Figure 39:
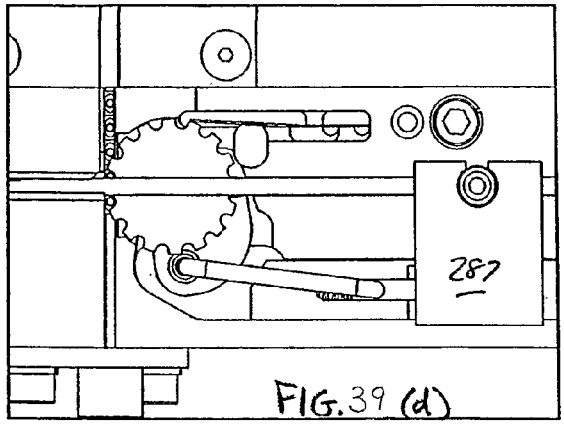
Figure 39:
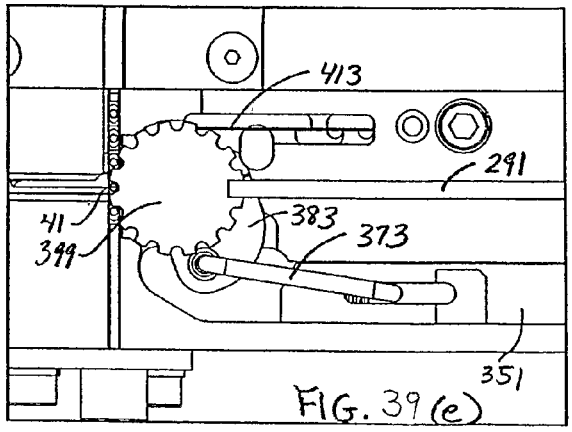

FIG. 39(*a*) represents selected components of the indexing mechanism as slide 287 commences its forward trigger stroke. As slide 287 continues in its forward trigger stroke, eventually slide 287 contacts forward projection 365 on index slide 351, as represented in FIG. 39(*b*). At this point (i.e., approaching the completion of the forward stroke), further forward displacement of slide 287 causes index pawl 383 to rotate in the clockwise direction about opening 389. The clockwise rotation of index pawl 383 causes tooth 397 to similarly rotate in the clockwise direction and ratchet (i.e., jump) from engaging one notch 411 on sprocket 399 to engaging the next successive clockwise notch 411 in sprocket 399, as represented in FIG. 39(*c*).

At the completion of the forward stroke, drive cylinder 281 begins to pull slide 287 in the rearward direction, as represented in FIG. 39(*d*). As slide 287 continues in its rearward trigger stroke, eventually slide 287 contacts rearward projection 367 on index slide 351. At this point (i.e., approaching the completion of the rearward stroke), further rearward displacement of slide 287 causes index pawl 383 to rotate in the counterclockwise direction about opening 389. The counterclockwise rotation of index pawl 383 causes tooth 397 to engage notch 411 and, in turn, rotate sprocket 399 in the counterclockwise direction until the cross-bar 35 of the next successive fastener 31 in the fastener stock is disposed in direct axial alignment behind longitudinal bore 239 of needle 229, as represented in FIG. 39(*e*).

Figure 40:
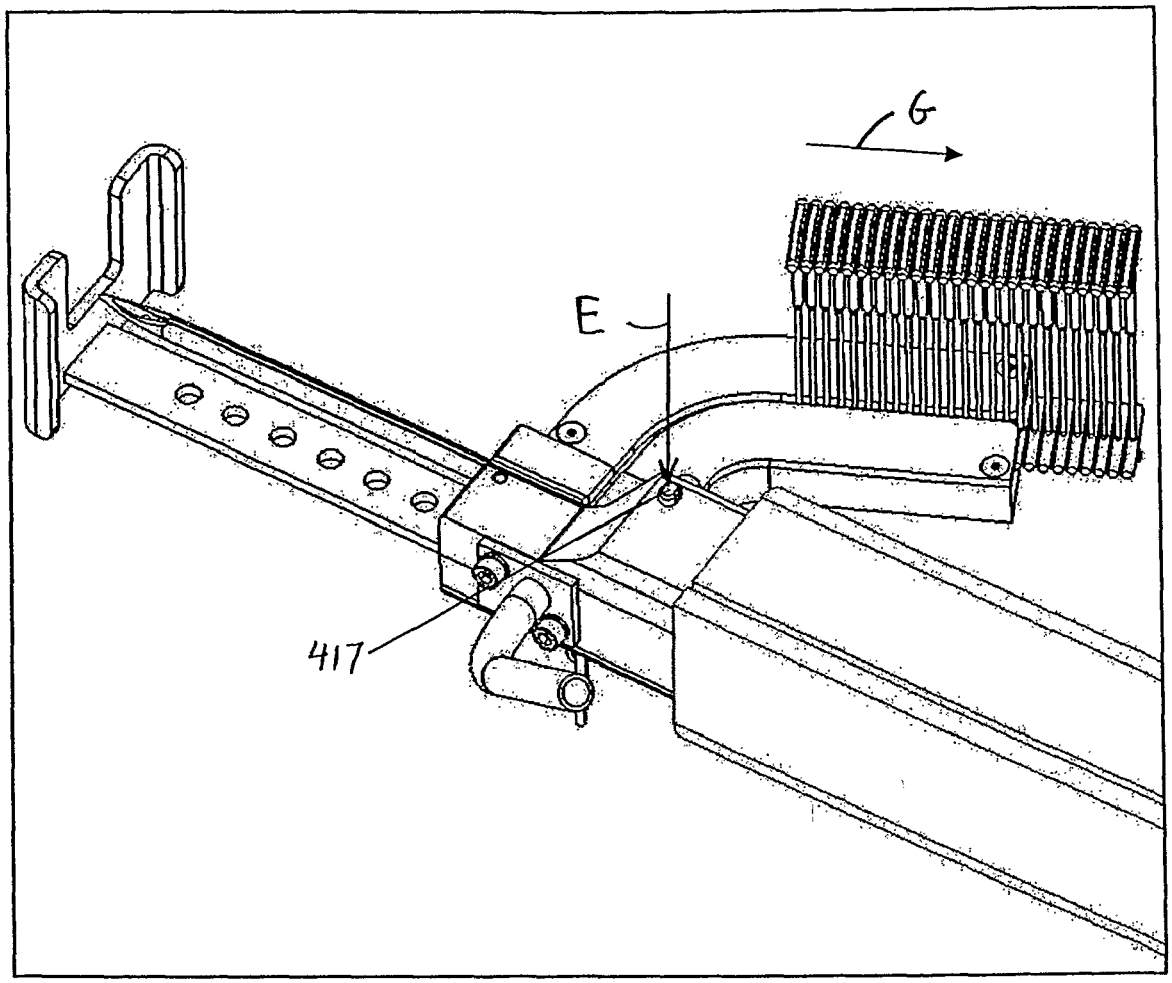
FIG. 40 is an enlarged, fragmentary, front perspective view of the tool shown in FIG. 4(*a*), the tool being shown with a clip of fastener being withdrawn therefrom.

It should be noted that detent 413 is designed to sequentially engage notches 411 to prevent sprocket 399 from rotating in the clockwise condition during the indexing process which, in turn, can cause the fastener stock to become jammed within tool 211. If fastener stock becomes jammed within tool 211, it is to be understood that the ability of springs 373 to absorb some of the jamming forces prevents particular components of tool 211 from becoming permanently damaged. Furthermore, in order to release (i.e., back out) jammed fastener stock from tool 211, the user can apply an inward force (as represented by arrow E in FIG. 40) onto the externally accessible portion of release button 417. The application of an inward force onto release button 417 causes release button spring 423 to compress which, in turn, inwardly displaces release button 417. As seen most clearly in FIG. 36(*a*), as release button 417 displaces inward (in the direction of arrow F), detent 413 rides upward along a curved surface 425 in hammer 419 and eventually becomes disengaged from notch 411 in sprocket 399. Simultaneously, as release button 417 displaces inward (in the direction of arrow F), arm 421 abuts against front surface 385 of index pawl 383. The application of said force on index pawl 383 causes bowed washer 395 to flatten which, in turn, causes tooth 397 on index pawl 383 to disengage from notch 411 in sprocket 399. While maintaining the inward force onto release button 417 (which, in turn, disengages detent 413 and index pawl 383 from sprocket 399), sprocket 399 can be rotated in the counterclockwise direction in order to withdraw (i.e., back out) the fastener stock from tool 211 (as represented by arrow G in FIG. 40) to eliminate the jamming condition.

In use, tool 211 may be used in the following manner to couple together multiple layers of a mattress with a fastener 31. Specifically, a length of tubing from a heavy duty pneumatic power source (not shown) is coupled directly to the large sized input valve 333 in valve support block 303. A supply of fastener stock is advanced into channel 349 of fastener guide assembly 341 until the severable connector 41 associated with the lowermost fastener 31 in the fastener stock aligns within a corresponding notch 409 in sprocket 399. With the supply of fastener stock fed into tool 211 in this manner, the cross-bar 35 of the lowermost fastener 31 is disposed in direct axial alignment behind longitudinal bore 239 of needle 229. At this point, tool 211 is ready for use in securing together multiple layers of a mattress with one or more fasteners 31.

Prior to dispensing fasteners 31 from tool 211, it is recommended that the user adjust the effective length of needle 229 by fixing the position of needle guard 243. Accordingly, while pulling on ring 277, needle guard 243 is linearly displaced until the desired indicia 255 aligns within circular window 279 in right side casing 215 (thereby denoting the proper setting for needle guard 243). At this time, the force applied onto ring 277 is released which causes locking member 267 to fix needle guard 243 in place.

With needle guard 243 locked in a particular setting, the user grasps tool 211 using handle 223 and penetrates the sharpened tip of needle 229 through the layers of the mattress, as shown in FIG. 15. It should be noted that, as needle 229 is penetrated through the desired layers, eventually surface 259 of contact plate 257 abuts against the outer surface of the mattress to preclude further penetration of needle 229.

While maintaining needle 229 disposed through the desired layers, the user depresses trigger cover 325 which, in turn, activates the pneumatically-driven forward trigger stroke. The forward trigger stroke causes ejector rod 291 to advance the cross-bar 35 of the lowermost fastener 31 through bore 239 of needle 229 until it exits through the opened tip of needle 229. As such, cross-bar 35 of fastener is secured to the underside of the mattress layers and cross-bar 33 is secured to the topside of the mattress layers, as shown in FIG. 1. The release of trigger cover 325 commences the rearward trigger stroke which, in turn, indexes the next successive fastener 31 in place behind needle 229 for future dispensing operations.

It is to be understood that tool 211 could be modified without departing from the spirit of the present invention. For example, it is to be understood that tool 211 could be modified so as to render it safer to handle.

Figure 41A:
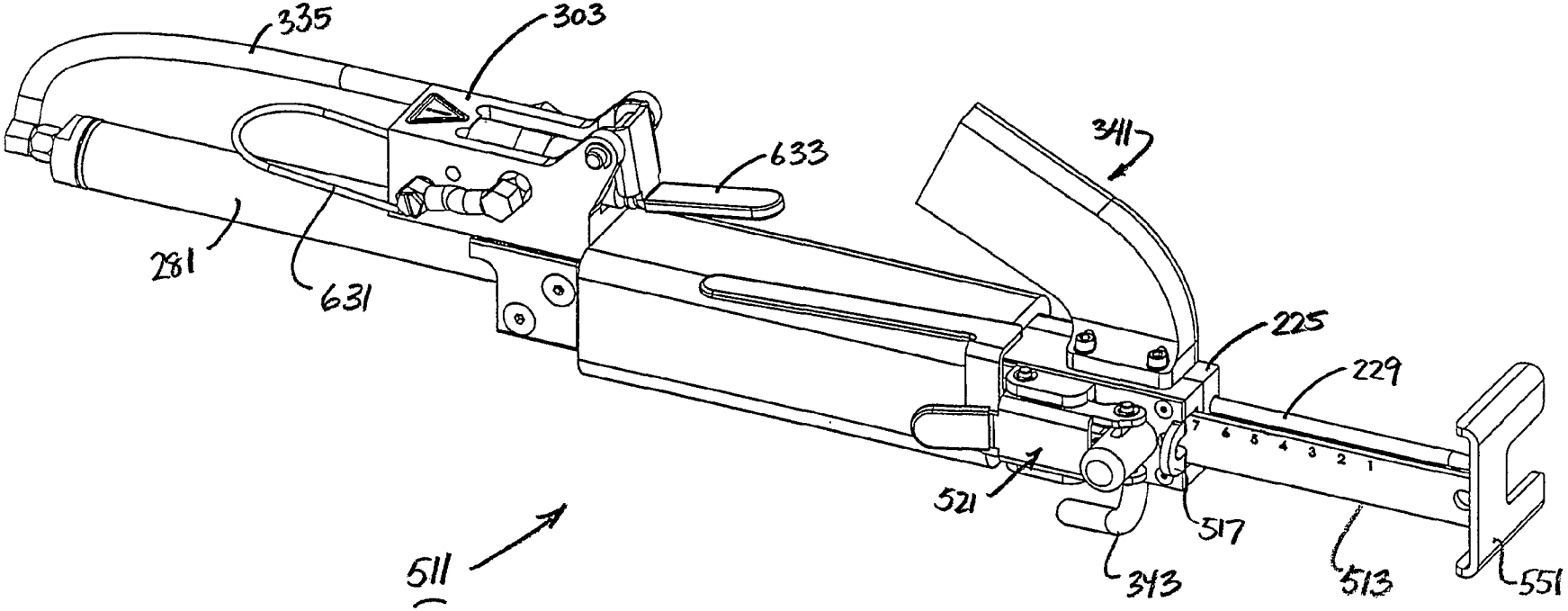
FIG. 41(*a*) is a rear, top perspective view of a second embodiment of a tool for dispensing a plastic fastener through one or more layers of a mattress, said tool being constructed according to the teachings of the present invention, the tool being shown with its needle guard disposed in its extended position.
Figure 41B:
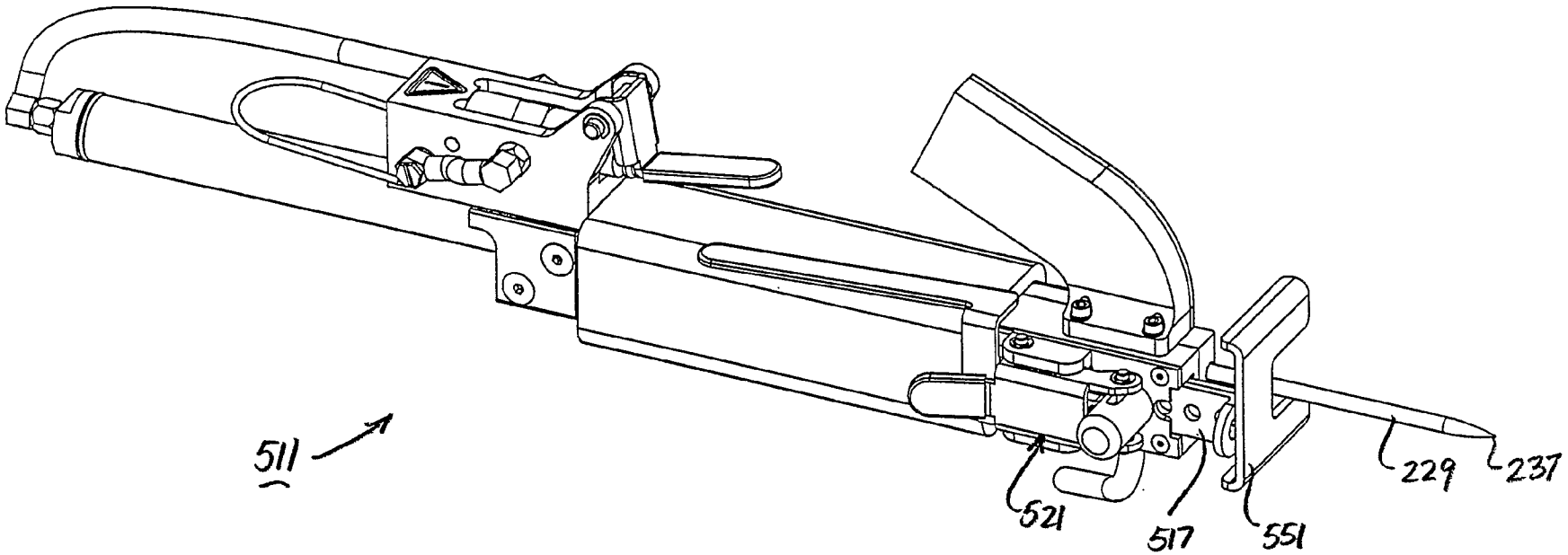

Specifically, referring now to FIGS. 41(*a*) and (*b*), there are shown rear, top perspective views of a second embodiment of a tool for use in dispensing one or more plastic fasteners, said tool being constructed according to the teachings of the present invention and identified generally by reference numeral 511. It should be noted that tool 511 is similar to tool 211 in that tool 511 is designed principally for use in installing heavy-duty plastic fasteners, such as fastener 31, through multiple layers of a mattress, such as mattress 11.

Tool 511 is similar to tool 211 in that tool 511 includes a pneumatically-driven ejection mechanism for dispensing a plastic fastener 31 through a hollow needle 229. It should be noted that tool 511 is identical in construction to tool 211 with the few notable distinctions to be described in detail herein.

As a first distinction, tool 511 differs from tool 211 in that tool 511 includes enhanced safety features for protecting the user from inadvertently contacting sharpened tip 237 of hollow needle 229. As will be described further below, tool 511 includes a slidably mounted needle guard 513 which is spring biased to resiliently extend past sharpened tip 237 of hollow needle 229. In use, needle guard 513 is adapted to be slidably displaced between an extended position (as shown in FIGS. 41(*a*) and 42(*a*)) in which needle guard 513 effectively protects the user from inadvertently contacting sharpened tip 237 of needle 229 and a retracted position (as shown in FIGS. 41(*b*) and 42(*b*)) in which a user-determined length of needle 229 is exposed (i.e., extends past needle guard 513) to allow for the insertion of needle 229 through particular items (e.g., the layers of a mattress).

Figure 43:
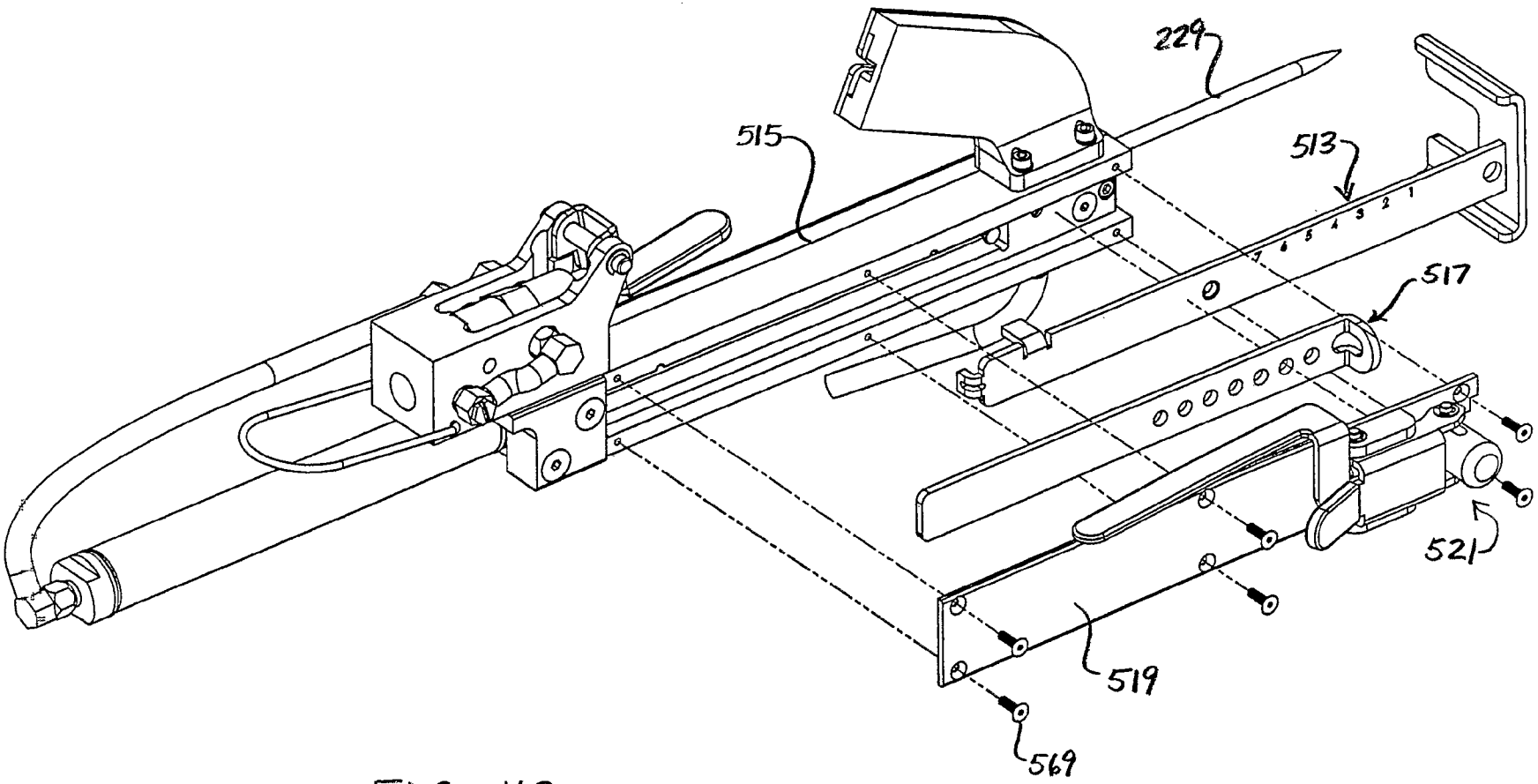
FIG. 43 is a partially exploded, rear, top perspective view of selected components of the tool shown in FIG. 41(*a*)

Referring now to FIG. 43, there is shown a rear, top perspective view of tool 511 which has been partially exploded to more clearly display the construction and operation of needle guard 513 with respect to the remainder of tool 511. Specifically, needle guard 513 is adapted to slide linearly within right side casing 515 (which is a modified version of right side casing 215 in tool 211). In turn, a needle guard stop 517 is slidably mounted on needle guard 513 and is retained in place thereagainst by a back plate 519. Furthermore, a locking pin assembly 521 is mounted on back plate 519 and is adapted to selectively engage needle guard 513 and needle guard stop 517 to lock them in place, as will be described in greater detail herein.

Figure 44:
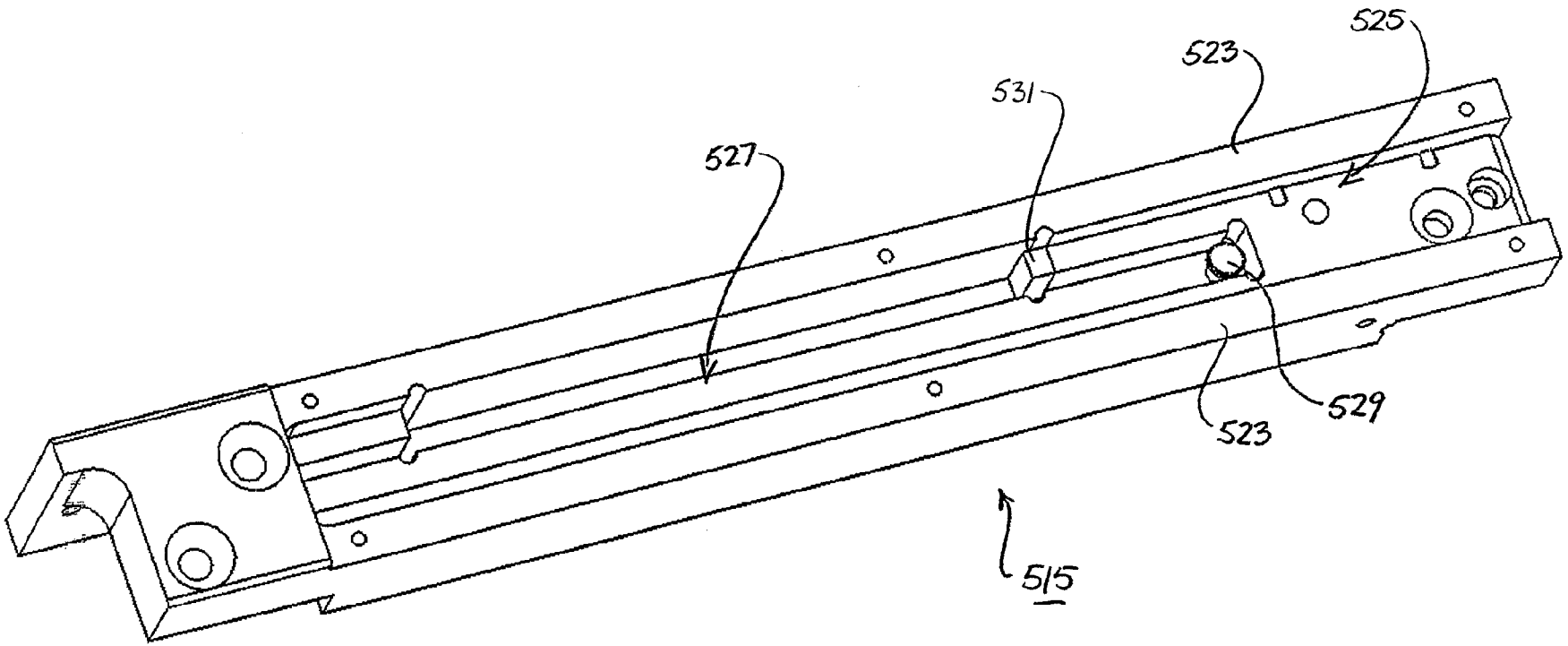
FIG. 44 is an enlarged, rear, bottom perspective view of the right side casing shown in FIG. 43.

Right side casing 515 (which is shown in isolation in FIG. 44) is constructed out of a rigid and durable material and is provided with a pair of raised side rails 523 which together define a track, or recess, 525 therebetween. As will be described further below, track 525 is sized and shaped to receive both needle guard 513 and needle guard stop 517 so as to limit their displacement to a substantially linear path. An elongated cavity 527 is formed into casing 515 within track 525. Furthermore, fixedly disposed within cavity 527 are a cylindrical post 529 and a rubber bumper 531, the function of post 529 and bumper 531 to become apparent below.

Figure 42A:
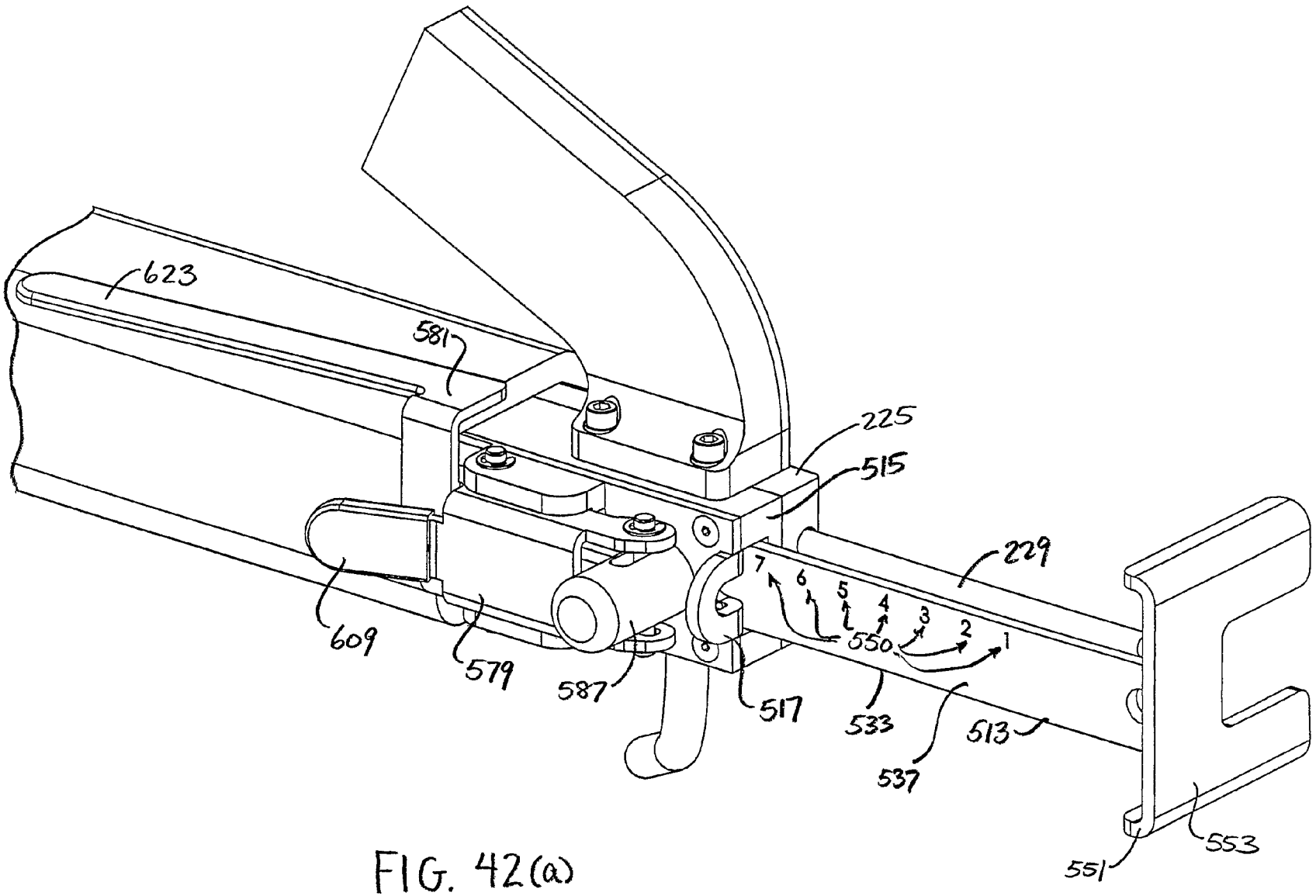
FIG. 42(*a*) is an enlarged, fragmentary view of the tool shown in FIG. 41(*a*)
Figure 42B:
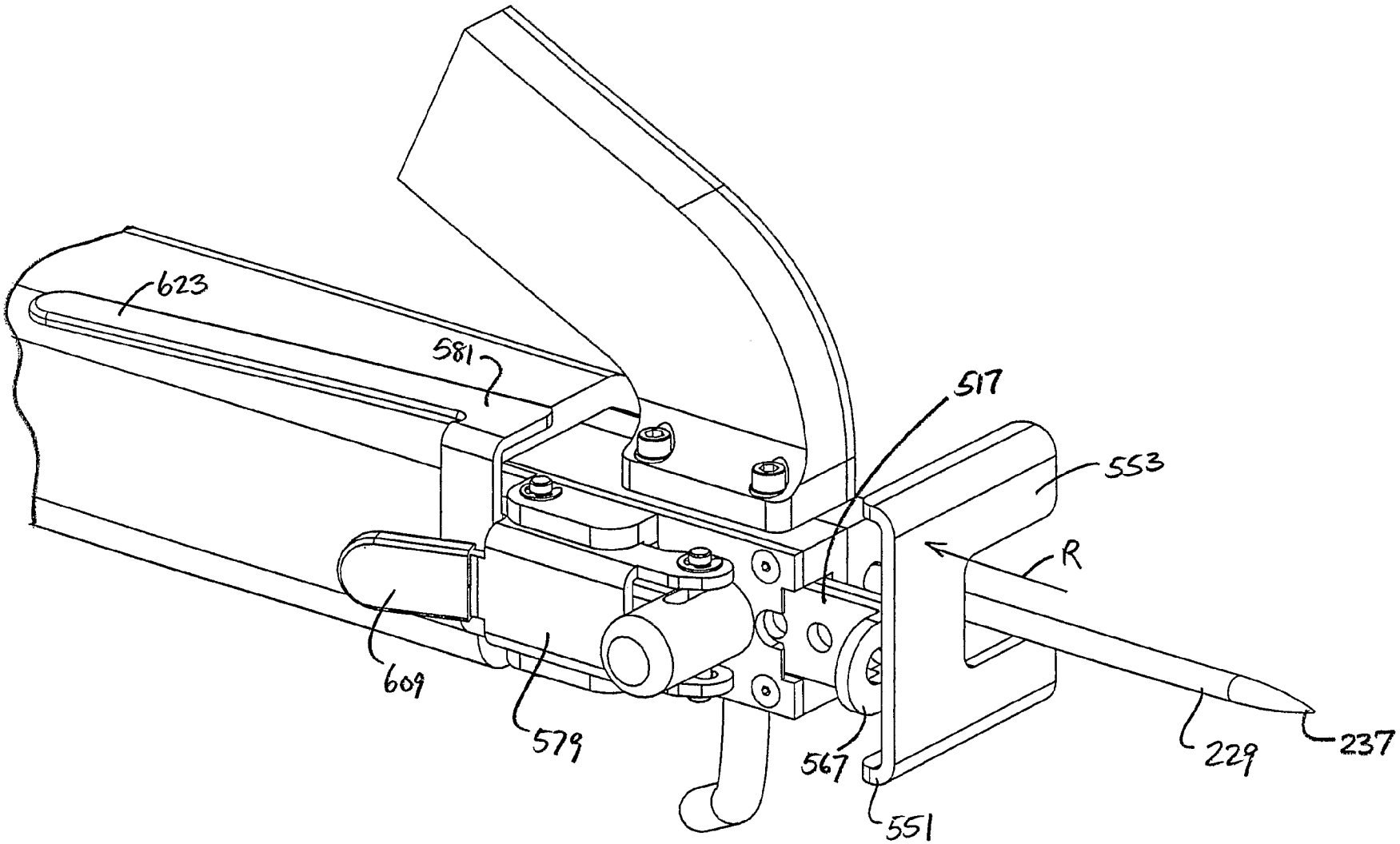
Figure 45:
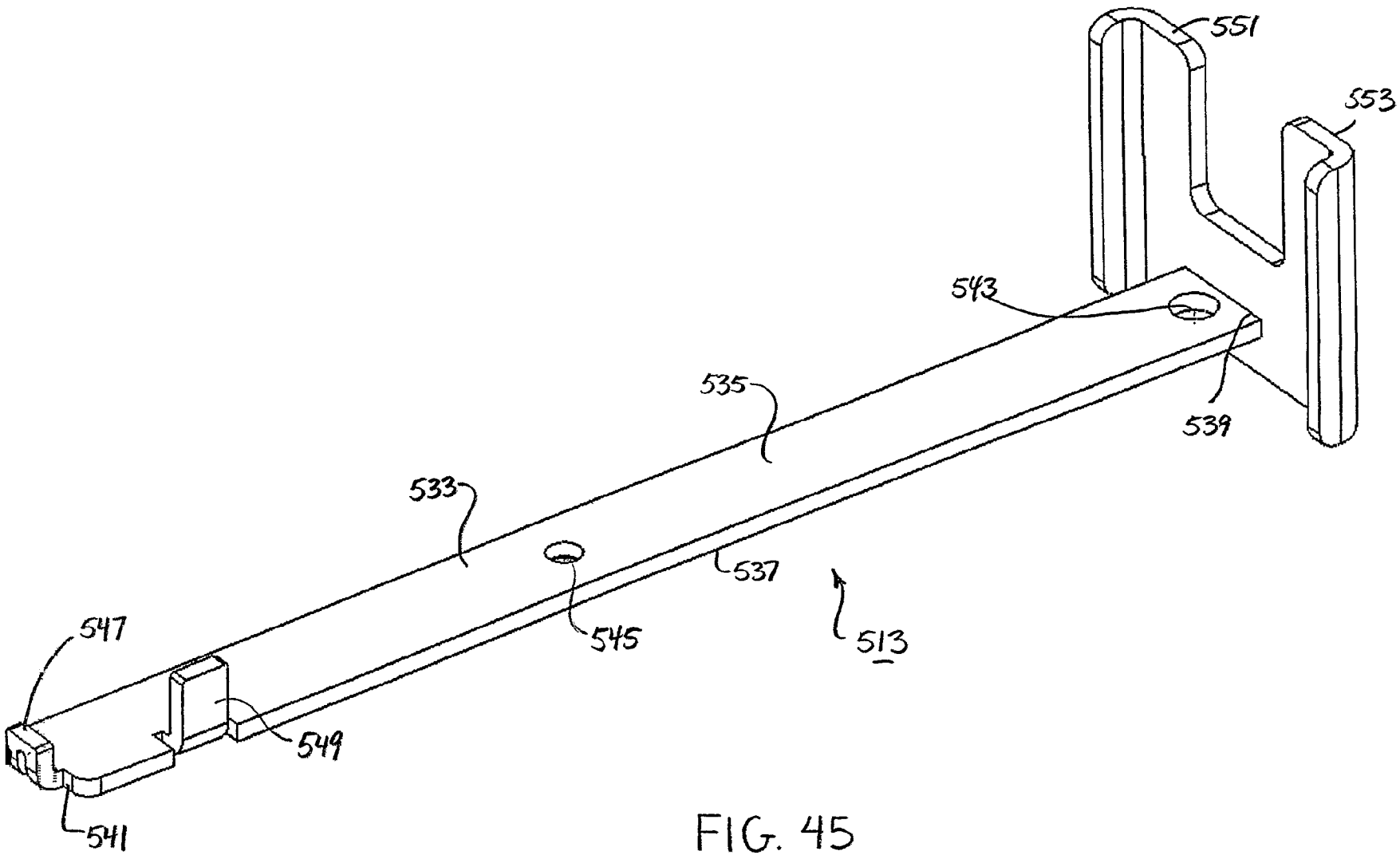
FIG. 45 is an enlarged, top, front perspective view of the needle guard shown in FIG. 43.

Needle guard 513 (which is shown in isolation in FIG. 45) is adapted for linear slidable displacement within track 525 of right side casing 515. Needle guard 513 is constructed out of a rigid and durable material, such as a nickel/Teflon coated steel, and includes an elongated arm 533. Arm 533 is in the form of a flat, rectangular bar and includes a front surface 535, a rear surface 537, a first end 539 and a second end 541. A first circular opening 543 is formed into elongated arm 533 proximate first end 539 and a second circular opening 545 is formed into elongated arm 533 at its approximate midpoint. In addition, a hook 547 and a stop 549 are formed into arm 533 at second end 541, hook 547 and stop 549 extending orthogonally out from front surface 535. Furthermore, indicia 550 (represented herein as being in the form of the sequence of numbers from 1 to 7) is provided onto rear surface 537 of arm 533 (as seen most clearly in FIG. 42(*a*)) in order to provide the user with a visible marker as to the position of needle guard stop 517 relative to right side casing 515, as will be described further below.

A U-shaped contact plate 551 is affixed onto first end 539 of arm 533 and extends orthogonally relatively thereto. Contact plate 551 includes a substantially flat contact surface 553 which is designed to press against the outer surface of the mattress through which fastener 31 is to be dispensed using tool 511. As can be appreciated, the ability to linearly slide needle guard 513 serves to displace contact plate 551 towards or away from the leading end of tool 511.

As noted above, needle guard 513 is sized and shaped to linearly slide within track 525 in right side casing 515 between an extended position (as represented in FIGS. 41(*a*) and 42(*b*)) and a retracted position (as represented in FIGS. 41(*b*) and 42(*b*)). A spring (not shown) connects at one end to hook 547 on needle guard 513 and connects at its opposite end to post 529 in right side casing 515 (with the remainder of the spring disposed within cavity 527). In this manner, the spring serves to resiliently urge contact plate 551 in the forward direction until stop 549 on needle guard 513 abuts against rubber bumper 531 on right side casing 515. With stop 549 abutting against bumper 531, needle guard 513 is disposed in its extended position. Positioned in this manner, contact plate 551 is located in front of sharpened tip 237 of hollow needle 229, thereby protecting a user from inadvertent skin pricks. However, upon the application of a suitable rearward force onto contact surface 553 (as represented by arrow R in FIG. 42(*b*)), needle guard 513 can be rearwardly displaced to its retracted position, thereby exposing needle 229 for insertion through one or more layers of a mattress.

It should be noted that the degree of retraction for needle guard 513 (i.e., the location of the retraction position relative to needle 229) can be adjusted between a number of different fixed settings. As a result, the length of needle 229 which extends past contact plate 551 when needle guard 513 is disposed in its retracted position can be adjusted to effectively limit the portion of needle 229 which is to extend through the layers of material. In this manner, the user is able to effectively modify the usable length of needle 229 without having to replace needle 229 with alternative needles of varying lengths, which is highly desirable.

Figure 46:
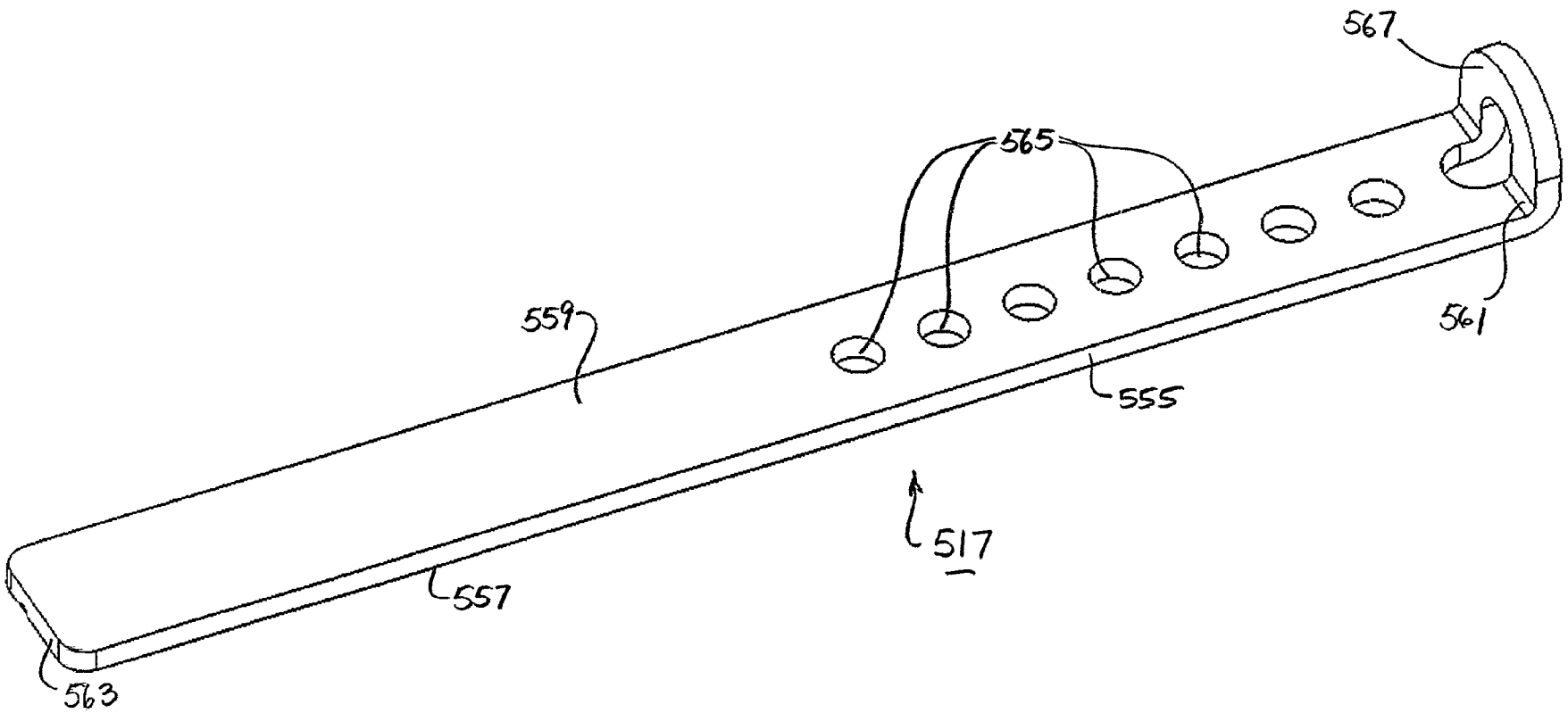
FIG. 46 is an enlarged, rear, bottom perspective view of the needle guard stop shown in FIG. 43.

Needle guard stop 517 (shown in isolation in FIG. 46) is responsible for limiting the degree of rearward displacement for needle guard 513, thereby effectively establishing the location of its retraction position. Needle guard stop 517 is constructed out of a rigid and durable material, such as a nickel/Teflon coated steel, and includes an elongated arm 555 which is in the form of a substantially flat plate. Arm 555 includes a front surface 557, a rear surface 559, a first end 561 and a second end 563. A plurality of circular openings 565 are formed into arm 555 proximate first end 561 in a substantially linear configuration, adjacent openings 565 being spaced apart an equal distance. In addition, an enlarged arcuate tab 567 is formed onto first end 561 of arm 555, tab 567 extending rearward from arm 555 at an approximate right angle relative to rear surface 559.

Needle guard stop 517 is mounted directly on needle guard 513, with front surface 557 of needle guard stop 517 disposed directly against rear surface 537 of needle guard 513. In this manner, needle guard stop 517 is adapted to slide along rear surface 537 of needle guard 513 in an independent manner relative thereto. As will be described further below, tab 567 on needle guard stop 517 is designed to abut against the rear surface of contact plate 551 on needle guard 513. In this manner, with needle guard stop 517 fixed in place, tab 567 serves to limit the degree of rearward displacement by needle guard 513. As a result, needle guard stop 517 effectively sets the retraction position for needle guard 513.

Figure 47A:
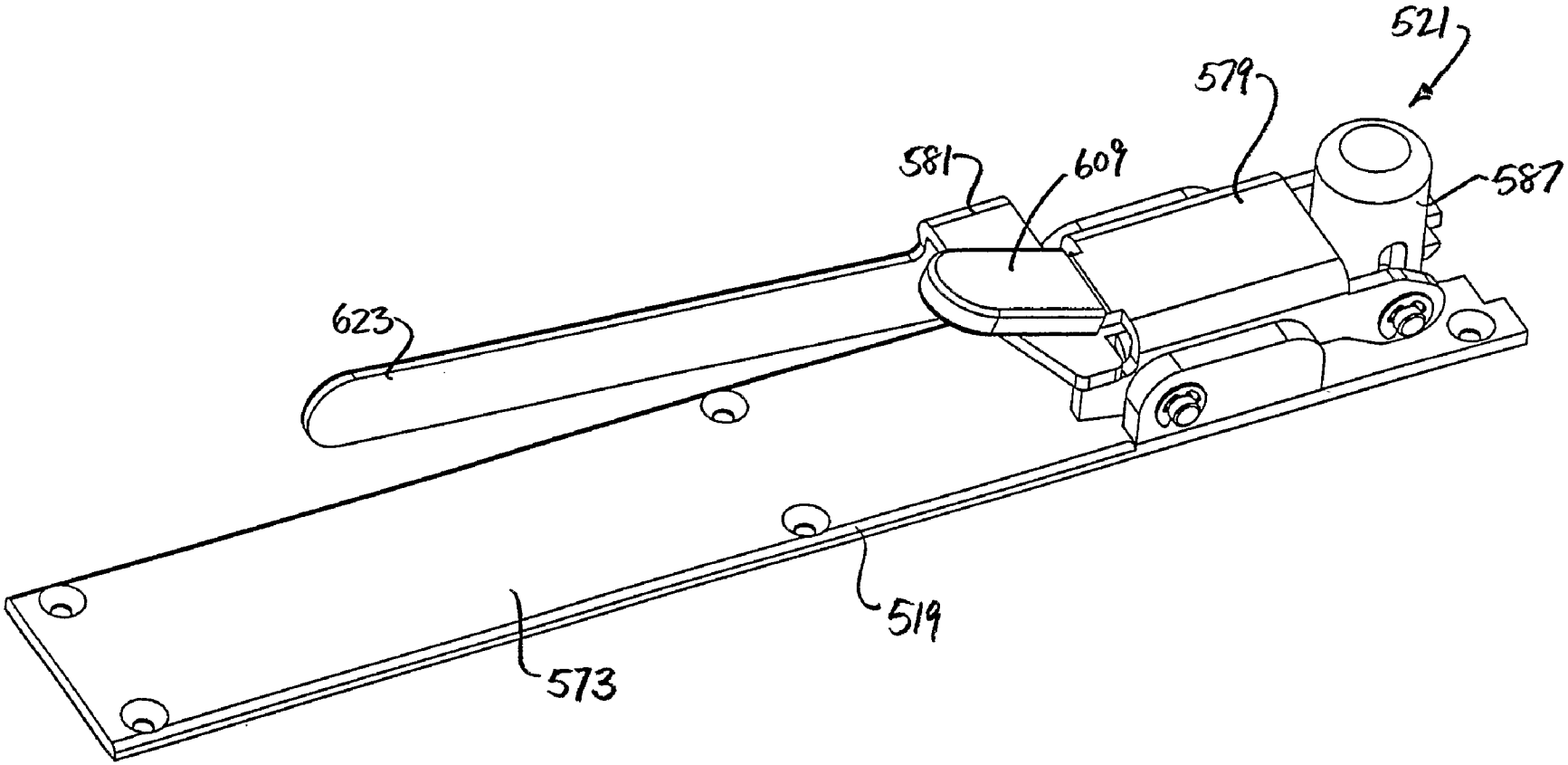
FIGS. 47(*a*) and (*b*) are enlarged, rear, bottom perspective and enlarged, front, bottom perspective views, respectively, of the back plate and locking pin assembly shown in FIG. 43.
Figure 47B:
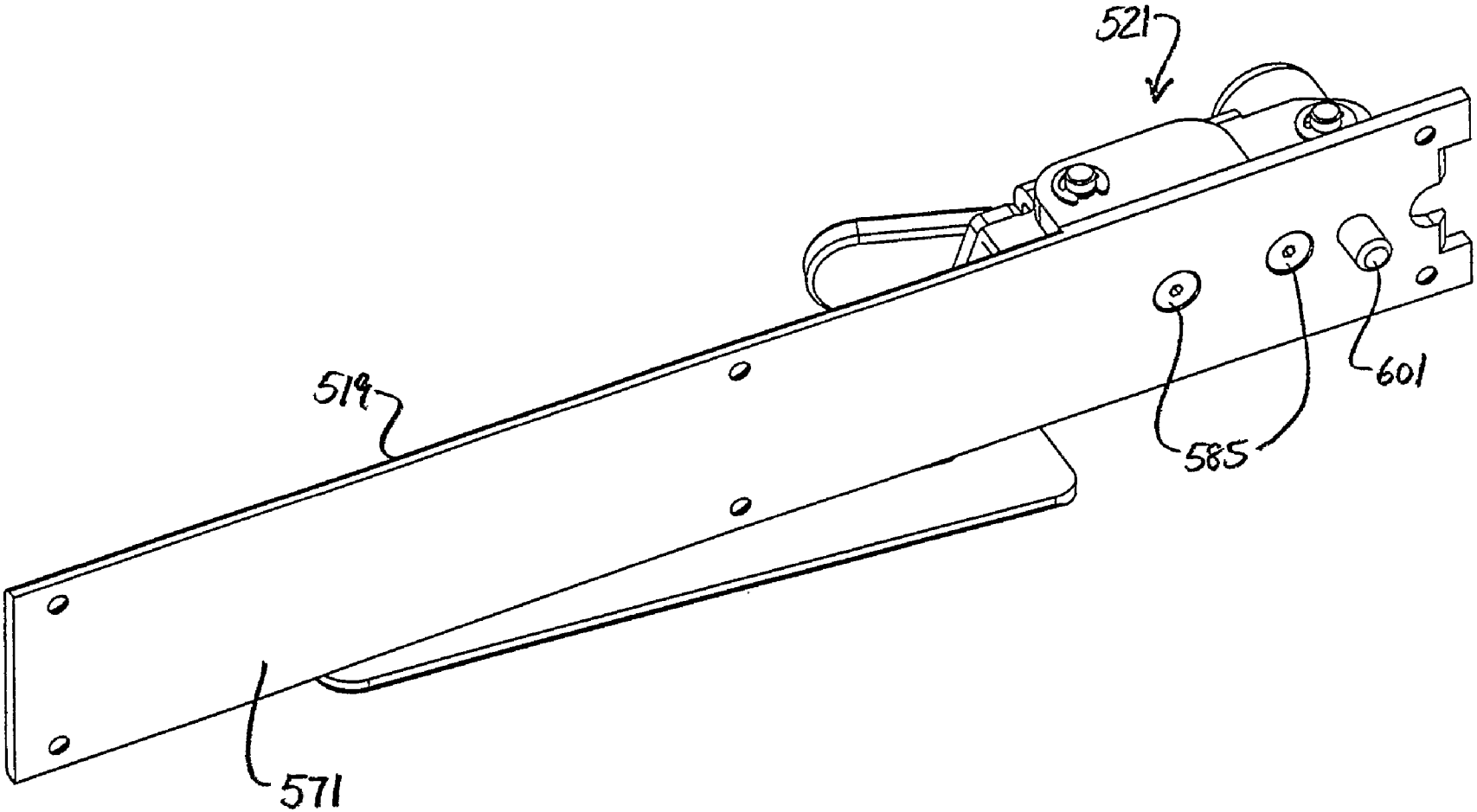

Referring now to FIGS. 43, 47(*a*), 47(*b*) and 48, back plate 519 is secured to left side casing 515 by screws 569 so as to retain needle guard 513 and needle guard stop 517 in place within track 525 in right side casing 515. Back plate 519 includes a substantially flat front surface 571 and a substantially flat rear surface 573.

Figure 48:
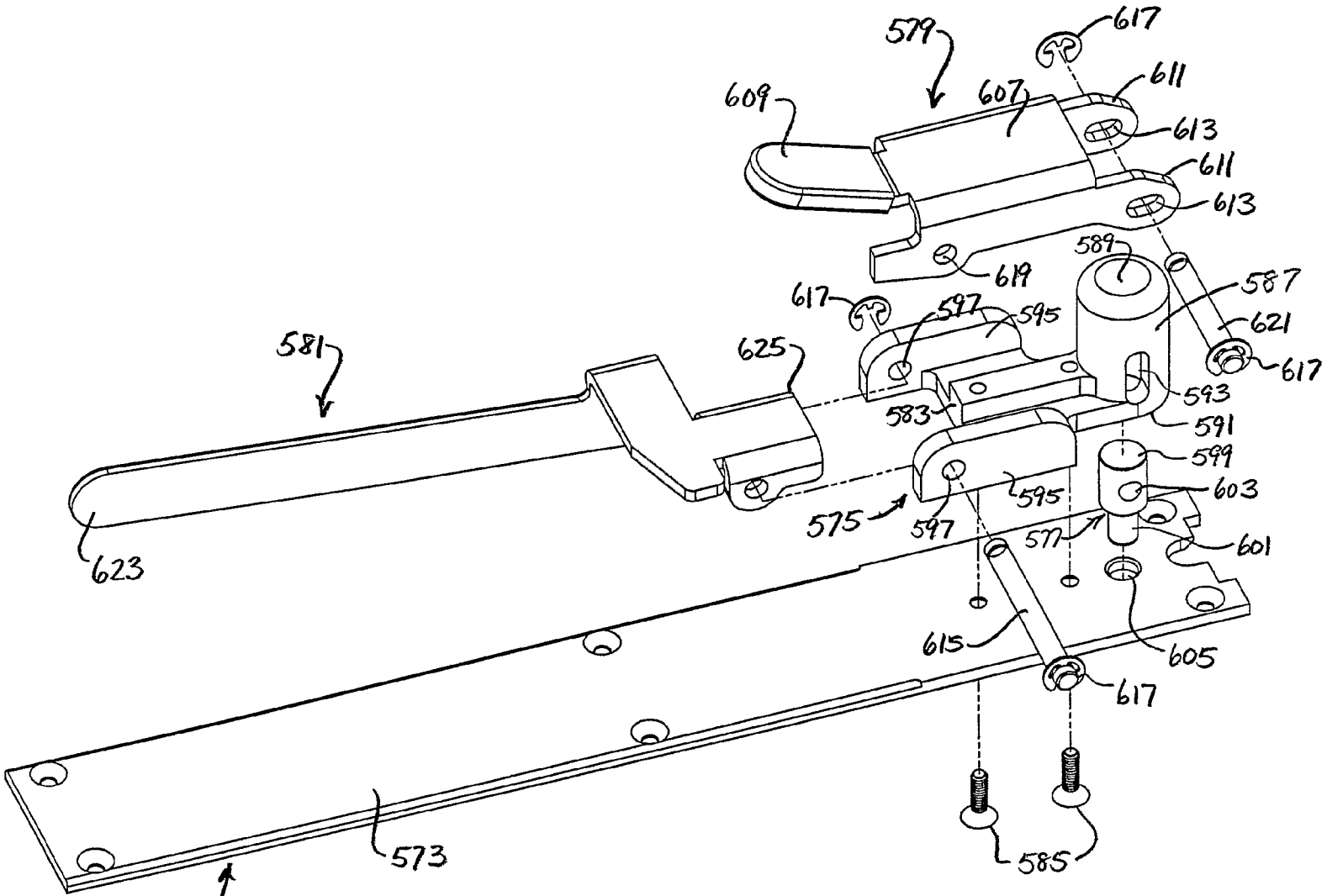
FIG. 48 is an enlarged, exploded, rear, bottom perspective view of the back plate and locking pin assembly shown in FIG. 43.

Locking pin assembly 521 is mounted onto rear surface 573 of back plate 519 and serves to selectively lock needle guard 513 and needle guard stop 517 fixed in place. As seen most clearly in FIG. 48, locking pin assembly 521 comprises a base 575 fixedly mounted onto rear surface 573 of back plate 519, a locking pin 577 axially mounted within base 575 and adapted for selective penetration through back plate 519, a needle guard stop adjustment lever 579 pivotally coupled to base 575 and fixedly coupled to locking pin 557 and a needle guard release lever 581 pivotally coupled to base 575 over needle guard stop adjustment lever 579.

Base 575 includes a central support member 583 which is fixedly secured onto rear surface 573 of back plate 519 by a pair of screws 585. A locking pin cover 587 is formed onto one end of support member 583. Locking pin cover 587 is in the form of a hollowed cylinder which includes an enclosed end 589 and an open end 591, open end 591 being disposed against rear surface 573. A pair of complimentary slots 593 is formed into locking pin cover 587 at approximately 180 degrees apart from one another, each slot 593 extending linearly along a portion of its length. Base 575 additionally includes a pair of spaced apart shoulders 595, each shoulder 595 being shaped to define a circular bore 597.

Locking pin 577 is adapted for longitudinal displacement within cover 587 of base 575 and comprises an enlarged first end 599 and a reduced second end 601 which are integrally formed together and which are co-axially aligned. First end 599 is sized and shaped to fit within the interior of locking pin cover 587 and is shaped to define a bore 603 therethrough. Second end 601 is sized and shaped to selectively penetrate through a hole 605 in back plate 519 and, in turn, into engagement with needle guard 513 and needle guard stop 517, as will be described further below.

A spring (not shown) is disposed within locking pin cover 587 between the inner surface of enclosed end 589 and first end 599 of locking pin 577. In this manner, the spring serves to resiliently urge second end 601 of locking pin 577 forward so as to penetrate through hole 605 in back plate 519.

Needle guard stop adjustment lever 579 includes a U-shaped support member 607 which is provided with a rearwardly extending finger depression tab 609 and a pair of forward extending arms 611, each arm 611 being shaped to define an elongated slot 613.

U-shaped support member 607 is pivotally coupled to shoulders 595 of base 575 by a pin 615. Specifically, pin 617 is sized and shaped to protrude through bores 597 in base 575 as well as through holes 619 in lever 579, pin 617 being held in place by a pair of retaining rings 617. Coupled as such, pin 615 serves as a pivot point about which lever 579 is free to rock, or pivot.

Arms 611 of lever 579 are additionally fixedly coupled to locking pin 577 by a pin 621. Specifically, pin 621 is sized and shaped to protrude through slots 613 in lever 579, through slots 593 in locking pin cover 587 as well as through bore 603 in locking pin 577, pin 621 being held in place by a pair of retaining rings 617. In this manner, any pivoting of lever 579 about pin 615 in turn serves to displace locking pin 577 along a substantially linear path within locking pin cover 587. It should be noted that slots 613 are elongated (i.e., not circular) to compensate for the slight horizontal component when lever 579 pivots and thereby allow locking pin 577 to travel along a substantially linear path.

Needle guard release lever 581 includes a first end 623 which is sized, shaped and ergonomically-designed for frequent hand actuation and a second end 625 which is pivotally coupled to shoulders 595 of base 575 by pin 615. It should be noted that needle guard release lever 581 is pivotally coupled to base 575 over needle guard stop adjustment lever 579 and is configured to selectively the trailing end of support member 607.

As noted above, a spring disposed within locking pin cover 587 serves to resiliently urge locking pin 577 forward in such a manner so that second end 601 protrudes through hole 605 (as seen most clearly in FIG. 47(*b*)). It should be noted that, in the absence of any force onto levers 579 and 581, the spring urges locking pin 577 far enough forward that second end 601 can extend through an opening 565 in needle guard stop 517 as well as through an opening (i.e., either opening 543 or 545) in needle guard 513. In this manner, locking pin 577 can be used to lock needle guard 513 and needle guard stop 517 in place.

In order to unlock needle guard 513 and needle guard stop 517, the user is required to actuate a particular lever. As can be appreciated, the degree of retraction of locking pin 577 back into locking pin cover 587 (and, consequently, whether pin 577 disengages from only needle guard stop 517 or from both needle guard 513 and needle guard stop 517) is dependent upon which of levers 579 and 581 is actuated. Specifically, the application of a suitable downward force onto finger depression tab 609 of lever 579 causes pin 577 to fully retract, thereby unlocking needle guard 513 and needle guard stop 517 and, in turn, allowing for their slidable displacement. However, the application of a suitable downward force onto first end 623 of lever 581 causes pin 577 to only partially retract, the degree of retraction being such that needle guard 513 is unlocked for slidable displacement but, to the contrary, needle guard stop 517 remains engaged by pin 577 and, as a result, is incapable of slidable displacement.

In use, the above-described safety mechanism for tool 511 can be used in the following manner. When tool 511 is not in use, needle guard 513 is naturally spring biased into its extended, or protective, position. In other words, needle guard 513 is urged forward until contact plate 551 extends past sharpened tip 237 of sharpened needle 229. With needle guard 513 positioned as such, locking pin 577 extends through an opening 565 in needle guard stop 517 as well as through opening 545 in arm 533 to lock needle guard 513 in its extended position.

In order to operate tool 511, the user must first regulate the length (i.e., the degree or portion) of needle 229 which is to extend through the layers of desired material. Accordingly, the user is required to adjust needle guard stop 517 to a particular setting in order to establish the extent of retraction for needle guard 513. In order to set the position of needle guard stop 517, the user depresses finger depression tab 609 on trigger 579. With trigger 579 depressed, the user manually grasps tab 567 on needle guard stop 517 and adjusts it accordingly. It should be noted that indicia 550 provided on rear surface 537 of needle guard 513 serves as a marker by which the user can accurately locate the desired position of needle guard stop 517. With needle guard stop 517 disposed in its desired setting, the user releases lever 579 which, in turn, causes second end 601 of locking pin 577 to penetrate through a particular opening 565, thereby locking needle guard stop 517 in place.

With needle guard stop 517 having being set to its proper position, the user then grasps tool 511 in such a manner so as to depress first end 623 of lever 581. The depression of first end 623 of lever 581 retracts second end 601 of locking pin 577 from an opening in needle guard 513 which, in turn, renders needle guard 513 unlocked and capable of slidable displacement. While maintaining lever 581 in a depressed state, the user urges contact surface 553 of contact plate 551 against the desired layers of materials. Upon the application of a suitable force, contact plate 551 moves rearward, thereby exposing needle 229 for insertion through the desired layers. Contact plate 551 continues to move rearward until its rear surface abuts against tab 567 on needle guard stop 517, thereby limiting its further rearward displacement. At this time, needle guard 513 is disposed in its retracted position which, in turn, establishes the maximum exposed length of needle 229 which can be inserted through the layers of a mattress. With tool 511 positioned as such, one or more plastic fasteners 31 can be dispensed by tool 511 through the mattress layers.

Upon completion of the dispensing process, tool 511 is removed from the mattress. In turn, the spring-biased nature of needle guard 513 urges it back to its extended position in order to protect the user from inadvertent needle pricks. With needle guard 513 back in its extended position, the user releases lever 581 which, in turn, causes second end 601 of locking pin 577 to penetrate through an opening 565 in needle guard lock 517 as well as through opening 545 in needle guard 513 which, in turn, locks needle guard 513 in its extended position until further use is required, which is highly desirable.

It should be noted that, in order to replace needle 229 for tool 511, needle guard 513 must be retracted to its most rearward position. In other words, needle guard 513 must be retracted such that enlarged opening 543 aligns with needle lock bore 233 in nose 225. Positioned in this manner, the needle lock can be removed and the needle replaced.

As a second distinction, tool 511 has been provided with a counterbalance hook 631. Specifically, referring back to FIG. 41(*a*), a counterbalance hook 631 is provided which is in the form of a rigid hook-shaped member that is fixedly secured onto valve support block 303. In use, counterbalance hook 631 allows for tool 511 to be suspended by a counterbalance for ease in frequent handling (e.g., in an assembly line-type environment).

As a third distinction, tool 511 has been provided with a longer trigger for greater ease in actuation of the pneumatically-driven fastener ejection system. Specifically, as seen most clearly in FIG. 41(*a*), trigger 319 in tool 211 has been replaced with a trigger 633 in tool 511, trigger 633 being slightly longer in length than trigger 319 in order to accommodate two finger actuation (as opposed to the single finger actuation trigger in tool 211).

As a fourth distinction, tool 511 includes a modified needle locking screw (not shown). Specifically, rather than using a needle lock 231 which is adapted for adjustment using a flat-head screwdriver in order to lock needle 229 in place within nose 225 (as shown in FIG. 4(*c*) for tool 211), tool 511 preferably utilizes a needle lock which is adapted for adjustment using an alien wrench.

The embodiments shown of the present invention are intended to be merely exemplary and those skilled in the art shall be able to make numerous variations and modifications to them without departing from the spirit of the present invention. All such variations and modifications are intended to be within the scope of the present invention as defined in the appended claims.

What is claimed is:

1. A tool for dispensing a plastic fastener, the plastic fastener comprising a cross-bar formed onto one end of a thin filament, said tool comprising:

(a) a housing, (b) a hollow needle fixedly coupled to the housing, the hollow needle comprising a sharpened tip, (c) an ejection mechanism for advancing the cross-bar of the plastic fastener through the hollow needle, (d) a needle guard slidably coupled to the housing, the needle guard being adapted for slidable displacement between an extended position in which sharpened tip of the hollow needle is substantially protected by the needle guard and a retracted position in which the sharpened tip of the needle is exposed, and (e) a needle guard stop slidably coupled to the needle guard, the needle guard stop being adapted to be releasably fixed in place in either of two or more set positions, (f) wherein, with the needle guard stop fixed in place in one of the two or more set positions, the needle guard is disposed to abut against the needle guard stop when displaced to its retracted position, the needle guard stop thus limiting the extent of the retraction of the needle guard and thereby regulating the portion of the hollow needle that is exposed.

2. The tool as claimed in claim 1 wherein the needle guard is spring biased to its extended position.

3. The tool as claimed in claim 1 wherein the needle guard stop is shaped to define a plurality of openings.

4. The tool as claimed in claim 3 further comprising a locking pin assembly for selectively engaging one of the plurality of openings in the needle guard stop so as to lock the needle guard stop fixed in place relative to the housing.

5. The tool as claimed in claim 1 wherein said needle guard includes a U-shaped contact plate that is coupled to an elongated rectangular arm.

6. The tool as claimed in claim 1 wherein said ejection mechanism comprises:

(a) a pneumatic drive cylinder, (b) a slider slidably disposed within the housing, the slider being coupled to the drive cylinder, (c) an ejector rod coupled to the slider, the ejector rod being disposed to selectively project through the hollow needle, and (d) a finger operable valve assembly for regulating the operation of the pneumatic drive cylinder, the finger operable valve assembly including a four-way valve.

7. The tool as claimed in claim 1 wherein the needle is approximately 3 inches in length.

8. The tool as claimed in claim 1 further comprising, (a) a fastener guide assembly coupled to said housing, said fastener guide assembly being adapted to guide the plastic fastener into the tool, the plastic fastener being connected to a runner bar, and (b) a runner bar guide coupled to the housing, the runner bar guide being adapted to receive the runner bar after the plastic fastener has been dispensed by the tool.

9. The tool as claimed in claim 8 wherein each of said fastener guide assembly and said runner bar guide is curved such that its free end is directed away from the sharpened tip of the hollow needle.

10. A tool for dispensing a plastic fastener, the plastic fastener comprising a cross-bar formed onto one end of a thin filament, said tool comprising:

(a) a housing, (b) a hollow needle fixedly coupled to the housing, the hollow needle comprising a sharpened tip, (c) an ejection mechanism for advancing the cross-bar of the plastic fastener through the hollow needle, (d) a needle guard slidably coupled to the housing, the needle guard being adapted for slidable displacement between an extended position in which the sharpened tip of the hollow needle is substantially protected by the needle guard and at least one retracted position in which the sharpened tip of the needle guard is exposed, the position of the needle guard relative to the hollow needle defining the portion of the hollow needle that is exposed for insertion, and (e) a locking member for locking the needle guard fixed in place in the at least one retracted position.

11. The tool as claimed in claim 10 wherein said needle guard includes a U-shaped contact plate that is coupled to an elongated arm, the elongated arm being shaped to define a plurality of holes.

12. The tool as claimed in claim 11 wherein the locking member is sized and shaped to selectively penetrate through one of the plurality of holes in the elongated arm to fix the needle guard in a particular position relative to the hollow needle.

13. The tool as claimed in claim 12 wherein the needle guard is retained within a linear recess formed in the housing by a back plate.

14. A tool for dispensing a plastic fastener, the plastic fastener comprising a cross-bar formed onto one end of a thin filament, said tool comprising:

(a) a housing, (b) a hollow needle fixedly coupled to the housing, the hollow needle comprising a sharpened tip, (c) an ejection mechanism for advancing the cross-bar of the plastic fastener through the hollow needle, (d) a needle guard slidably coupled to the housing, the needle guard being adapted for slidable displacement between an extended position in which sharpened tip of the hollow needle is substantially protected by the needle guard and a retracted position in which the sharpened tip of the needle is exposed, the needle guard being spring biased to its extended position, (e) a needle guard stop slidably coupled to the needle guard, the needle guard stop being adapted to be releasably fixed in place in either of two or more set positions, the needle guard stop being shaped to define a plurality of openings, and (f) a locking pin assembly for selectively engaging one of the plurality of openings in the needle guard stop so as to lock the needle guard stop fixed in place relative to the housing, the locking pin assembly including a locking pin which is capable of being disposed between a first position in which the locking pin engages both the needle guard and the needle guard stop, a second position in which the locking pin engages with the needle guard stop but disengages from the needle guard and a third position in which the needle guard disengages from both the needle guard and the needle guard stop, (g) wherein, when in its retracted position, the needle guard contacts the needle guard stop so as to limit further retraction of the needle guard and thereby regulate the portion of the hollow needle that is exposed.

15. The tool as claimed in claim 14 wherein the locking pin is spring biased to its first position.

16. The tool as claimed in claim 15 wherein the locking pin assembly includes a needle guard release lever which, when actuated, disposes the locking pin in its second position.

17. The tool as claimed in claim 16 wherein the locking pin assembly includes a needle guard stop adjustment lever which, when actuated, disposes the locking pin in its third position.

18. The tool as claimed in claim 17 wherein the needle guard is adapted to be engaged by the locking pin assembly when disposed in its extended position.

19. The tool as claimed in claim 18 wherein the needle guard and needle guard stop are retained within a linear track formed in the housing by a back plate.

20. The tool as claimed in claim 19 wherein the locking pin assembly is mounted on the back plate.

* * * * *